US007030331B2

(12) United States Patent
Sasaki

(10) Patent No.: US 7,030,331 B2
(45) Date of Patent: Apr. 18, 2006

(54) PUSH SWITCH DEVICE

(75) Inventor: Yasunori Sasaki, Miyagi-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 27 days.

(21) Appl. No.: 10/761,780

(22) Filed: Jan. 20, 2004

(65) Prior Publication Data

US 2004/0149560 A1 Aug. 5, 2004

(30) Foreign Application Priority Data

Jan. 30, 2003 (JP) ..... 2003-022333
Dec. 8, 2003 (JP) ..... 2003-409271

(51) Int. Cl.
*H01H 3/12* (2006.01)

(52) U.S. Cl. ..... 200/341; 200/4

(58) Field of Classification Search ..... 200/11 R, 200/11 G, 4, 526–528, 292, 416, 417, 533, 200/570, 573, 574, 229
See application file for complete search history.

(56) References Cited

U.S. PATENT DOCUMENTS 4,891,476 A * 1/1990 Nation et al. ..... 200/11 R
5,049,709 A * 9/1991 Prickett et al. ..... 200/527
5,178,265 A * 1/1993 Sepke ..... 200/528
5,186,316 A * 2/1993 Mortun et al. ..... 200/527
5,967,301 A * 10/1999 Reed et al. ..... 200/523
6,809,281 B1 * 10/2004 Miki ..... 200/529

FOREIGN PATENT DOCUMENTS

EP 341901 * 11/1989

* cited by examiner

*Primary Examiner*—Elvin G. Enad
*Assistant Examiner*—Lisa Klaus
(74) *Attorney, Agent, or Firm*—Beyer, Weaver & Thomas

(57) ABSTRACT

In a push switch device, a first latchet tooth is formed to an actuation body composed of an elastomer, a second latchet tooth is formed to a cam follower composed of a synthetic resin material, and the first latchet tooth is meshed with the second latchet tooth by elastically urging the cam follower upward by a second coil spring as well as a first coil spring having a spring load smaller than that of the second coil spring is interposed between the actuation body and the cam follower. Then, the first latchet tooth is engaged with the second latchet tooth at an unstable position by regulating the rotation of the cam follower by the guide portion.

5 Claims, 17 Drawing Sheets

PUSH SWITCH DEVICE

BACKGROUND OF THE INVENTION

1. Field of the Invention

The present invention relates to a push switch device for switching contact elements by pushing an actuation body projecting from a housing. More particularly, the present invention relates to a push switch device for actuating a contact element switching mechanism by rotating an actuating member spline coupled with a cam follower by converting the movement of an actuation body in an axial direction into the rotation of the cam follower through a latchet mechanism.

2. Description of the Related Art

Heretofore, there is known, as this type of the push switch device, a push switch device arranged such that an end of an actuation body is projected from a housing formed in a hollow structure, a first latchet tooth is formed to the other end of the actuation body as well as a second latchet tooth is formed to a cam follower disposed in the housing so as to rotate, rise and fall, and a latchet mechanism is arranged by engaging the first and second latchet teeth with each other by urging the cam follower upward by a return spring (refer to, for example, U.S. Pat. No. 4,891,476). The first latchet tooth has a plurality of ridge portions and valley portions that alternately continue along the circumferential direction of the actuation body. Likewise, the second latchet tooth has a plurality of ridge portions and valley portions that alternately continue along the circumferential direction of the cam follower. Further, a guide portion, in which guide projections and guide grooves each extending in an axial direction are disposed adjacent to each other, is formed on the inner circumferential surface of the housing, the actuation body can be moved only in a rising/falling direction by being guided by the guide portion, and a cam portion is formed to the cam follower so as to be engaged with and disengaged from the guide portion. In an non-actuated state in which the end of the actuation body project from the housing, the rotation of the cam follower is regulated by the cam portion that enters into the guide grooves as well as the first latchet tooth is engaged with the second latchet tooth at an unstable position where the apexes of the ridge portions of the first latchet tooth are slightly offset from the apexes of the ridge portions of the second latchet tooth.

In the push switch device that is schematically arranged as described above, when the actuation body projecting from the housing is pushed against the spring force of the return spring, first, the cam follower falls in a predetermined amount while its rotation is regulated by the guide portion. When the actuation body is pushed to a position at which the cam portion is released from the lower ends of the guide projections, the ridge portions of the second latchet tooth receive the spring force of the return spring and are moved to a stable position at which they are engaged with the valley portions of the first latchet tooth, thereby the cam follower is rotated by an angle slightly smaller than one half the ridge of the first and second latchet teeth. As a result, the actuating member spline coupled with the cam follower is rotated by a predetermined angle, and thus a movable contact element disposed to the actuating member slides on a plurality of stationary contact elements disposed to a wafer, thereby the contacting/departing state of the movable contact element and the respective stationary contact elements is changed. When the push force acting on the actuation body is released, the actuation body and the cam follower are caused to rise to the original positions thereof by the spring force of the return spring. However, since the cam portion is abutted against the lower ends of the guide projections and enters into the guide grooves adjacent to the guide projections while the actuation body and the cam follower are being caused to rise, the cam follower is rotated by an angle slightly larger than the one half the ridge of the first and second latchet teeth, thereby the first latchet tooth is engaged with the second latchet tooth again at the unstable position at which the apexes of the ridge portions of them are slightly offset. At the time, since the actuating member is rotated in association with the cam follower, the movable contact element slides on the respective stationary contact elements. When, however, the movable contact element is set so as to slide on a common stationary contact element by pushing and releasing the actuation body once, it is possible to output an ON/OFF signal from a terminal that is brought into electric conduction with the respective stationary contact elements by repeatedly pushing and releasing the actuation body (U.S. Pat. No. 4,891,476, pages 4 to 7, FIGS. 1 to 16).

Incidentally, in the push switch device employing the above latchet mechanism, the first latchet tooth formed to the actuation body is engaged with the second latchet tooth formed to the cam follower by the spring force of the return spring, and the phase of the first and second latchet teeth is changed by pushing and releasing the actuation body. However, noise is generated by the abutment between the first and second latchet teeth when the phase of the ridge portions of the second latchet tooth is changed to the stable position at the time the actuation button is pushed and thus the second latchet tooth is abutted against the first latchet tooth and when the ridge portions of the second latchet tooth get over the ridge portions of the first latchet tooth at the time the actuation body is released from the push force and thus the phase of the ridges of the second latchet tooth is changed to the unstable position, from which a large problem arises in that the quality of the push switch device is deteriorated.

SUMMARY OF THE INVENTION

An object of the present invention, which was made in view of the problems of the known technology, is to provide a push switch device that can reduce noise.

To achieve the above object, a push switch device of the present invention comprises a housing arranged in a hollow structure and having a guide portion formed on an inner surface, an actuation body which can be moved in an axial direction by being guided by the guide portion and to which a first latchet tooth is formed so as to extend in a circumferential direction, a cam follower which is disposed in the housing so as to rotate as well as to move in an axial direction and to which a second latchet tooth is formed so as to be engaged with the first latchet tooth, a return spring for elastically urging the cam follower in the axial direction so that the first latchet tooth is engaged with the second latchet tooth, a rotatable actuating member spline coupled with the cam follower, and a contact element switching mechanism actuated by the rotation of the actuating member, wherein at least one of the actuation body and the cam follower is formed of an elastomer.

In the push switch device arranged as described above, at least one of the actuation body having the first latchet tooth and the cam follower having the second latchet tooth is formed of an elastomer having elasticity. Thus, there can be reduced the abutment noise, which is generated when the phase of the ridge portions of the second latchet tooth is changed to a stable position at the time the actuation button is pushed and thus the second latchet tooth is abutted against the first latchet tooth, and the noise, which is generated when the ridge portions of the second latchet tooth get over the ridge portions of the first latchet tooth at the time the actuation body is released from the push force and thus the phase of the ridges of the second latchet tooth is changed to an unstable position.

In the above arrangement, it is preferable that the actuation body be formed of the elastomer as well as the cam follower be formed of a plastomer whose elasticity is lower than that of the elastomer. With the above arrangement, when the actuation body is actuated through an actuator, the noise generated between the actuation body and the actuator can be also reduced. Moreover, since the phase of the second latchet tooth composed of the plastomer is changed with respect to the first latchet tooth composed of the elastomer, the wear of the first latchet tooth can be reduced. Further, since the cam follower is composed of the plastomer, the wear of other members (the housing and the actuating member) which are in sliding contact with the cam follower can be reduced, thereby a smoothly movable push switch device can be realized.

Further, to achieve the above object, a push switch device of the present invention comprises a housing arranged in a hollow structure and having a guide portion formed on an inner surface, an actuation body which can be moved in an axial direction by being guided by the guide portion and to which a first latchet tooth is formed so as to extend in a circumferential direction, a cam follower which is disposed in the housing so as to rotate as well as to move in an axial direction and to which a second latchet tooth is formed so as to be engaged with the first latchet tooth, a return spring for elastically urging the cam follower in the axial direction so that the first latchet tooth is engaged with the second latchet tooth, a rotatable actuating member spline coupled with the cam follower, and a contact element switching mechanism actuated by the rotation of the actuating member, wherein at least the extreme ends of the tooth portions of one of the first and second latchet teeth are formed in an arc shape.

In the push switch device arranged as described above, the extreme ends of the tooth portions of least one of the first latchet tooth formed to the actuation body and the second latchet tooth formed to the cam follower are rounded in the arc shape. Thus, there can be reduced the abutment noise which is generated when the ridge portions of the second latchet tooth get over the ridges of the first latchet tooth at the time the actuation body is released from the push force and thus the phase of the ridge portions of the second latchet tooth is changed to the unstable position, thereby the reduction of noise can be realized.

Further, to achieve the object described above, a push switch device of the present invention comprises a housing arranged in a hollow structure and having a guide portion formed on an inner surface, an actuation body which can be moved in an axial direction by being guided by the guide portion and to which a first latchet tooth is formed so as to extend in a circumferential direction, a cam follower which is disposed in the housing so as to rotate as well as to move in an axial direction and to which a second latchet tooth is formed so as to be engaged with the first latchet tooth, a return spring for elastically urging the cam follower in the axial direction so that the first latchet tooth is engaged with the second latchet tooth, a rotatable actuating member spline coupled with the cam follower, and a contact element switching mechanism actuated by the rotation of the actuating member, wherein an elastic member whose spring load is smaller than that of the return spring is interposed between the actuation body and the cam follower.

In the push switch device arranged as described above, the second latchet tooth of the cam follower is caused to come into pressure contact with the first latchet tooth of the actuation body by the spring force of the return spring, and the elastic member whose spring load is smaller than that of the return spring is interposed between the actuation body and the cam follower. Thus, when the phase of the ridge portions of the second latchet tooth is changed to the stable position at the time the actuation button is pushed and thus the second latchet tooth is abutted against the first latchet tooth and when the ridge portions of the second latchet tooth get over the ridge portions of the first latchet tooth at the time the actuation body is released from the push force and thus the phase of the ridges of the second latchet tooth is changed to the unstable position, the spring force of the return spring that intends to cause the second latchet tooth to come into pressure contact with the first latchet tooth is reduced by the elastic member. Therefore, the abutment noise generated between the first and second latchet teeth can be reduced while securing the initial push force necessary to the actuation body.

In the above arrangement, although it is also possible to use a rubber member, sponge, and the like as the elastic member, it is particularly preferable that both the return spring and the elastic member be composed of a coil spring. Further, in the above arrangement, it is preferable to form at least one of the actuation body and the cam follower of the elastomer. With this arrangement, the noise can be more effectively reduced.

In the push switch device of the present invention, at least one of the actuation body having the first latchet tooth and the cam follower having the second latchet tooth is formed of the elastomer and the extreme ends of the tooth portions of at least one of the first and second latchet teeth are formed in the arc shape. Thus, there can be reduced the abutment noise, which is generated when the phase of the ridge portions of the second latchet tooth is changed to the stable position at the time the actuation button is pushed and thus the second latchet tooth is abutted against the first latchet tooth, and the noise, which is generated when the ridge portions of the second latchet tooth get over the ridge portions of the first latchet tooth at the time the actuation body is released from the push force and thus the phase of the ridges of the second latchet tooth is changed to the unstable position. Therefore, the noise, which is generated from the first and second latchet tooth when the actuation body is pushed and released, can be reduced.

Further, in the push switch device of the present invention, the elastic member whose spring load is smaller than that of the return spring is interposed between the actuation body and the cam follower. Thus, when the phase of the ridge portions of the second latchet tooth is changed to the stable position at the time the actuation button is pushed and thus the second latchet tooth is abutted against the first latchet tooth, and when the ridge portions of the second latchet tooth get over the ridge portions of the first latchet tooth at the time the actuation body is released from the push force and thus the phase of the ridges of the second latchet tooth is changed to the unstable position, the spring force of the return spring that intends to cause the second latchet tooth to come into pressure contact with the first latchet tooth is reduced by the elastic member. Therefore, the abutment noise generated between the first and second latchet teeth can be reduced while securing the initial push force necessary to the actuation body.

DESCRIPTION OF THE PREFERRED EMBODIMENTS

Figure 1:
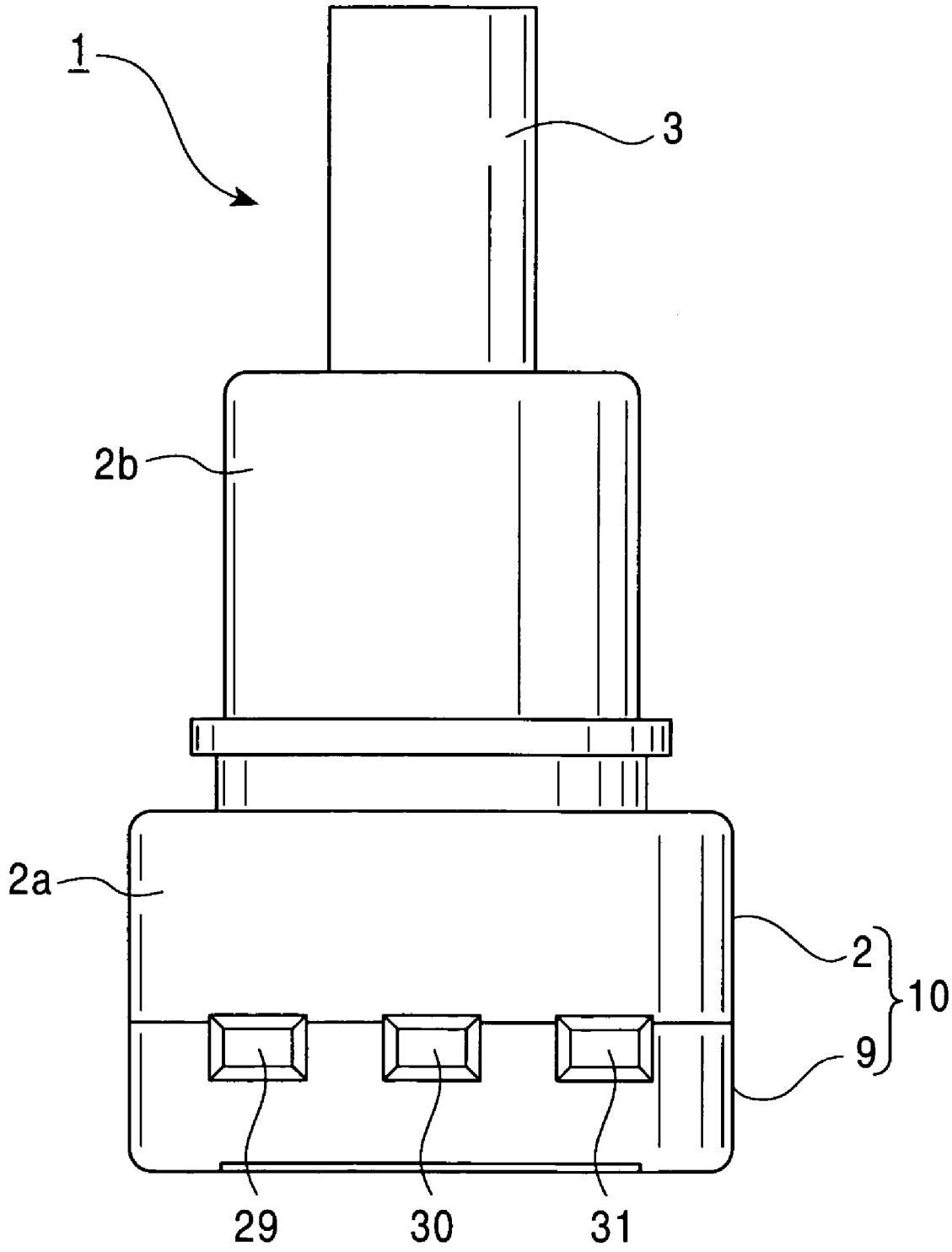
FIG. 1 is a front elevational view showing a push switch device according to an embodiment of the present invention.
Figure 2:
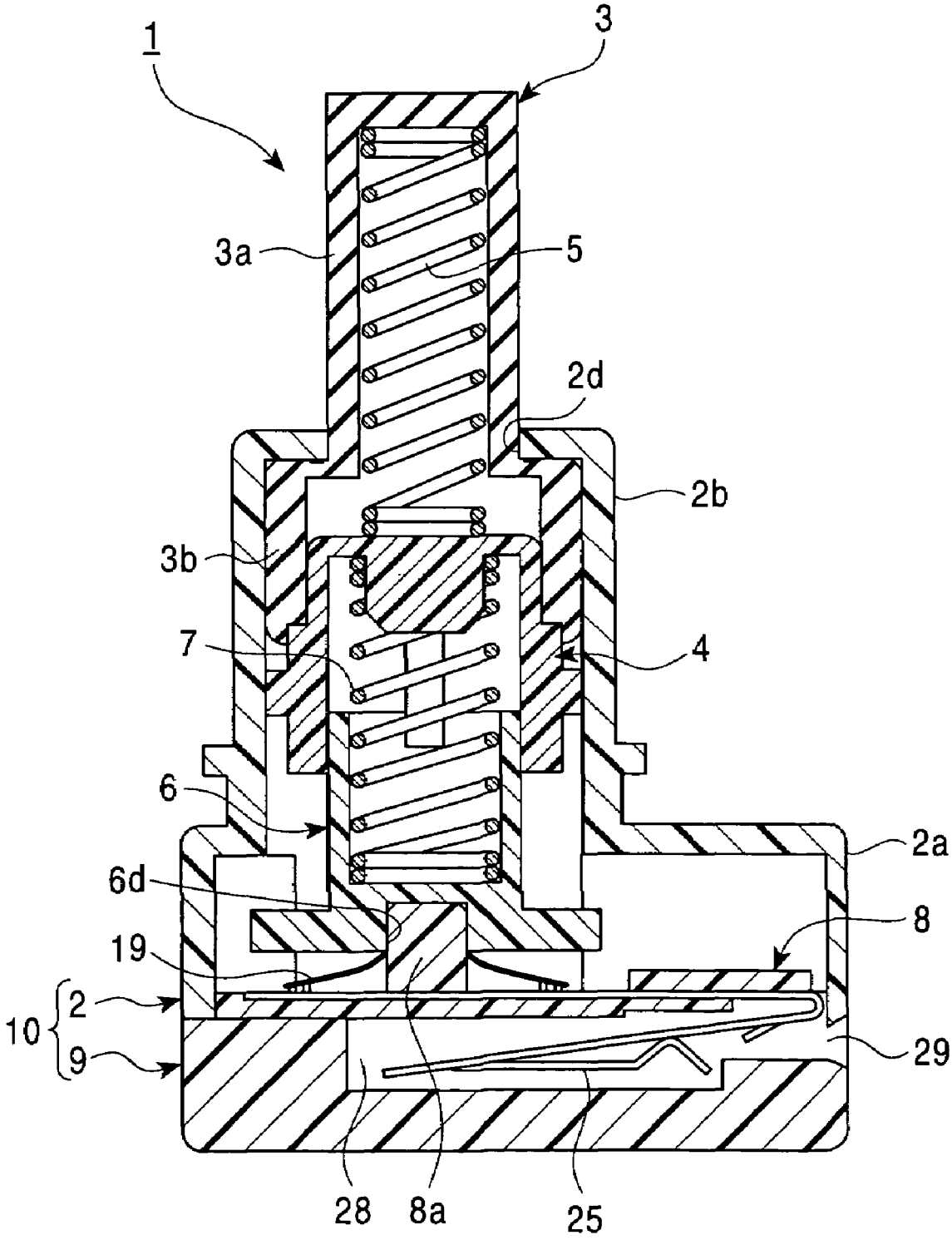
FIG. 2 is a sectional view showing a non-actuated state of the push switch device.
Figure 3:
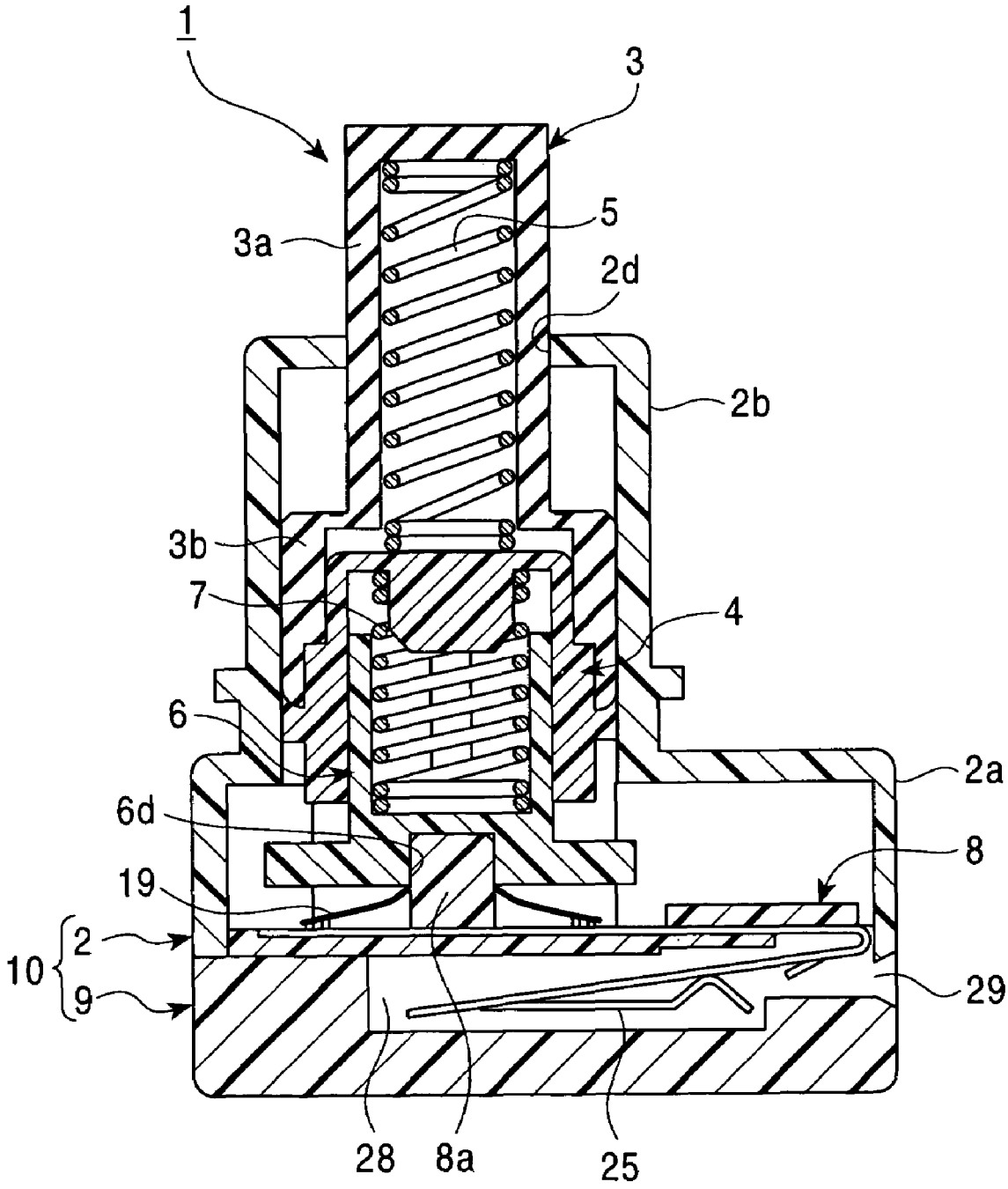
FIG. 3 is a sectional view showing a pushed-state of the push switch device.
Figure 4:
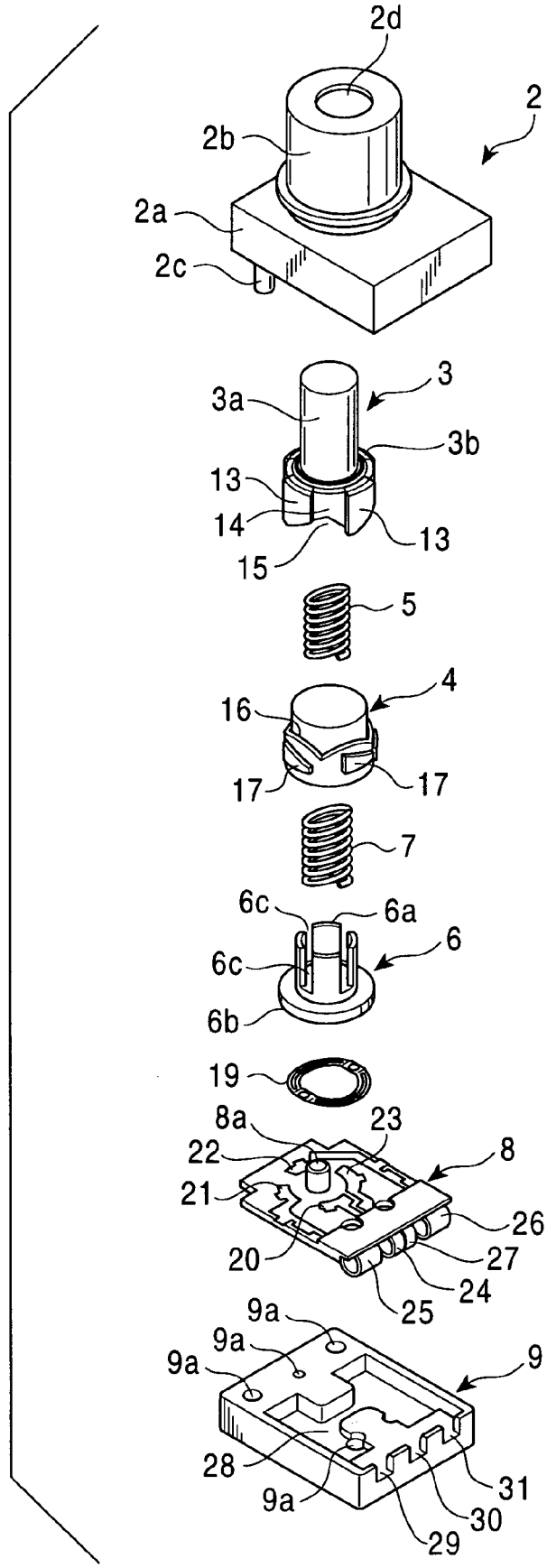
FIG. 4 is an exploded perspective view of the push switch device.
Figure 5:
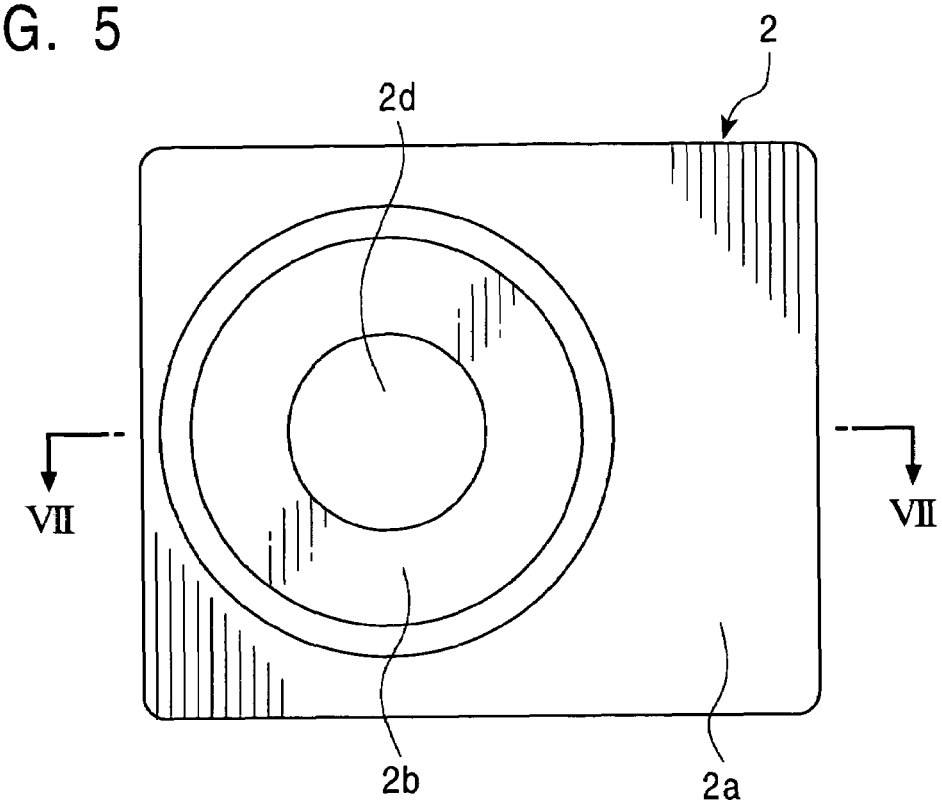
FIG. 5 is a plan view of a case provided with the switch device.
Figure 6:
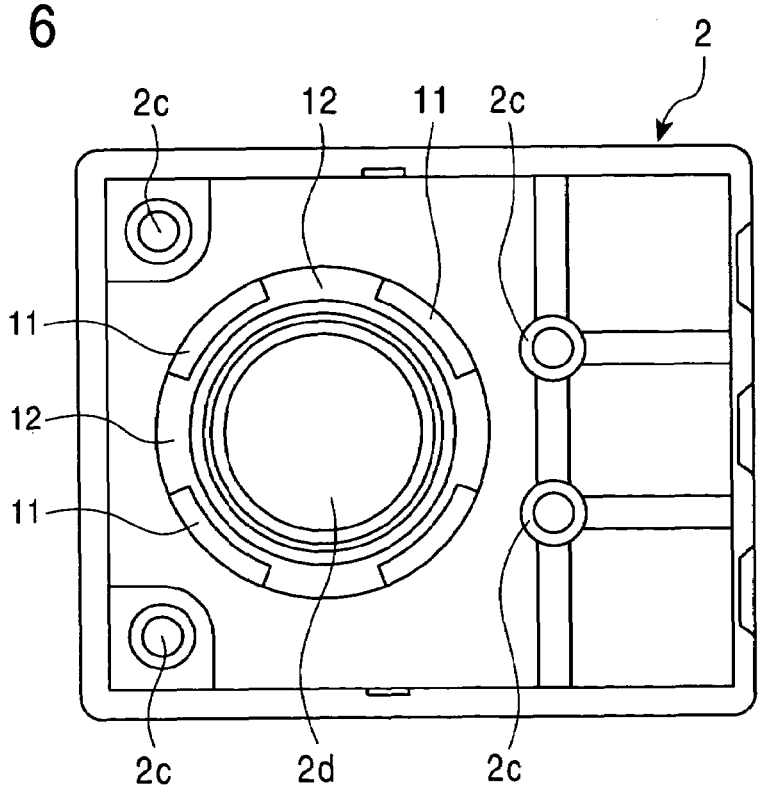
FIG. 6 is a bottom view of the case.
Figure 7:
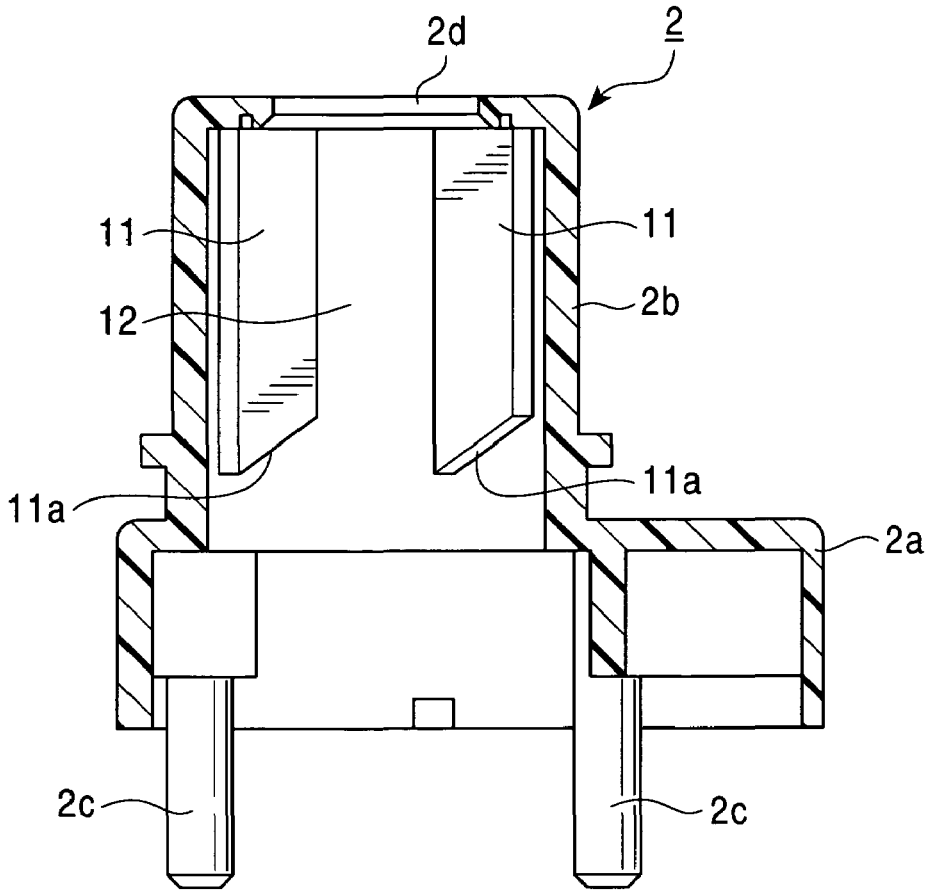
FIG. 7 is a sectional view of the push switch device taken along the line VII—VII of FIG. 5.
Figure 8:
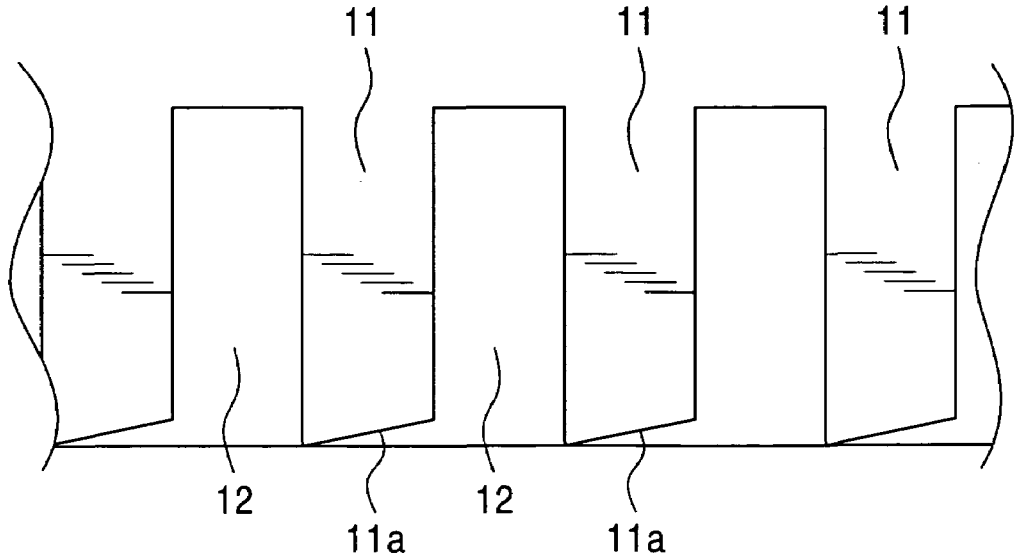
FIG. 8 is a view of a guide portion formed to the case and explains the guide portion by developing it.
Figure 9:
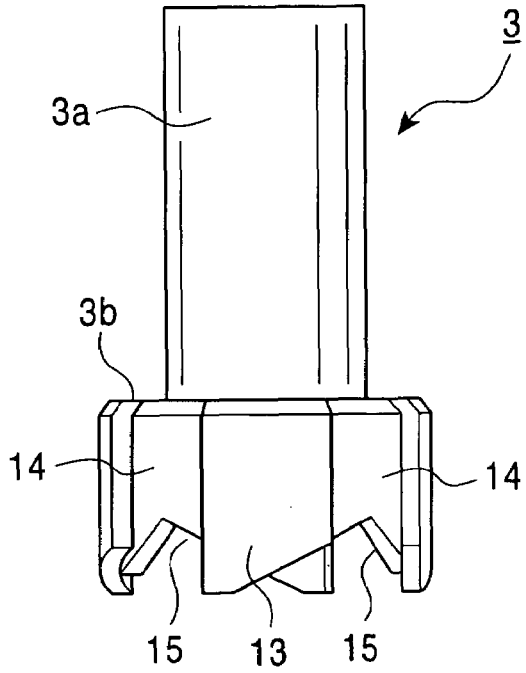
FIG. 9 is a front elevational view of an actuation body of the push switch device.
Figure 10:
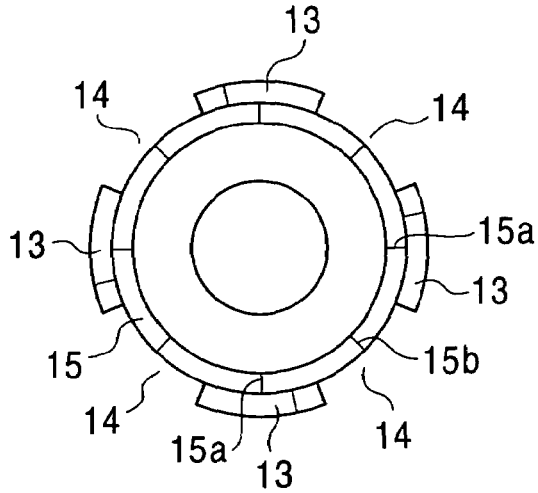
FIG. 10 is a bottom view of the actuation body.
Figure 11:
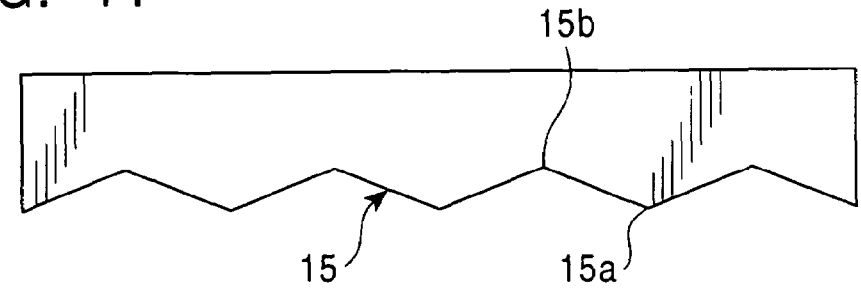
FIG. 11 is a view of a first latchet tooth formed to the actuation body and explains the latchet tooth by developing it.
Figure 12:
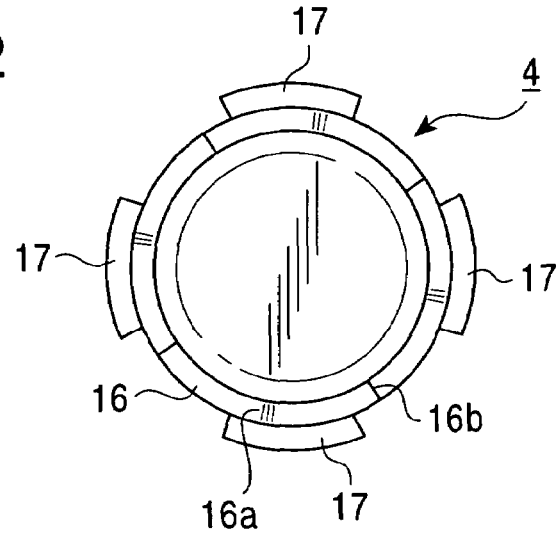
FIG. 12 is a plan view of a cam follower provided with the push switch device.
Figure 13:
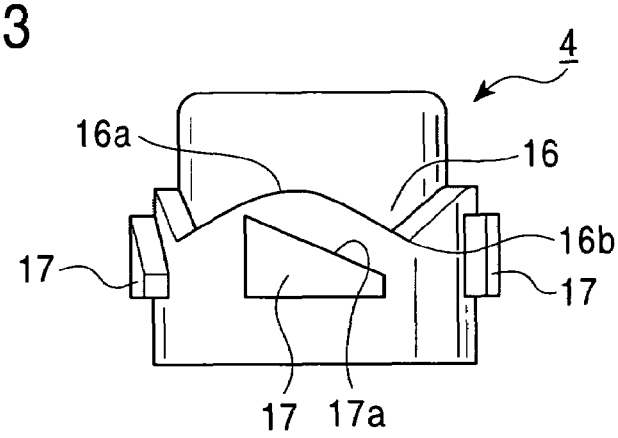
FIG. 13 is a front elevational view of the cam follower.
Figure 14:
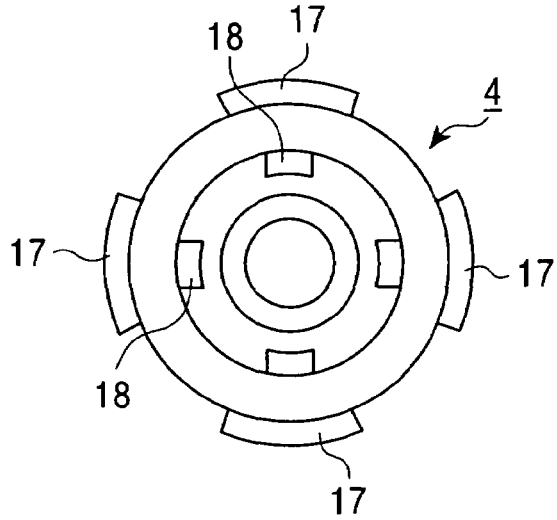
FIG. 14 is a bottom view of the cam follower.
Figure 15:
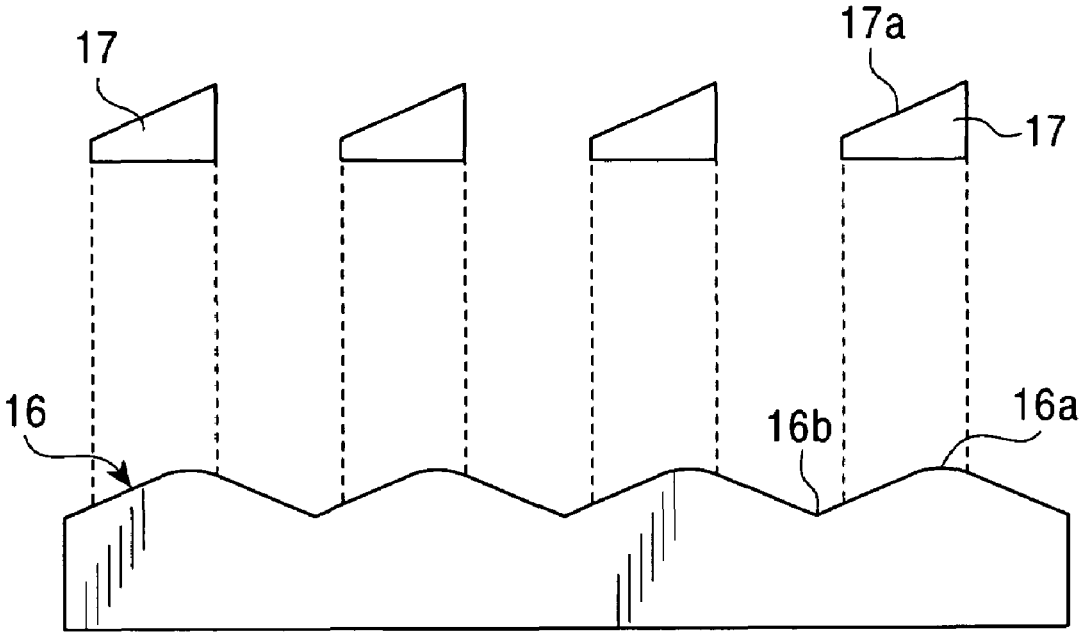
FIG. 15 is a view of a second latchet tooth formed to the cam follower and explains the latchet tooth by developing it.
Figure 16:
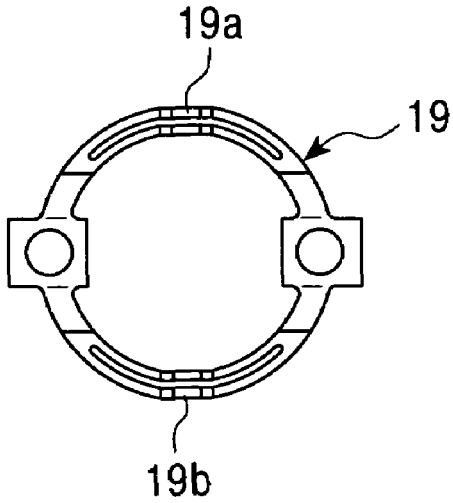
FIG. 16 is a plan view of a movable contact element provided with the push switch device.
Figure 17:
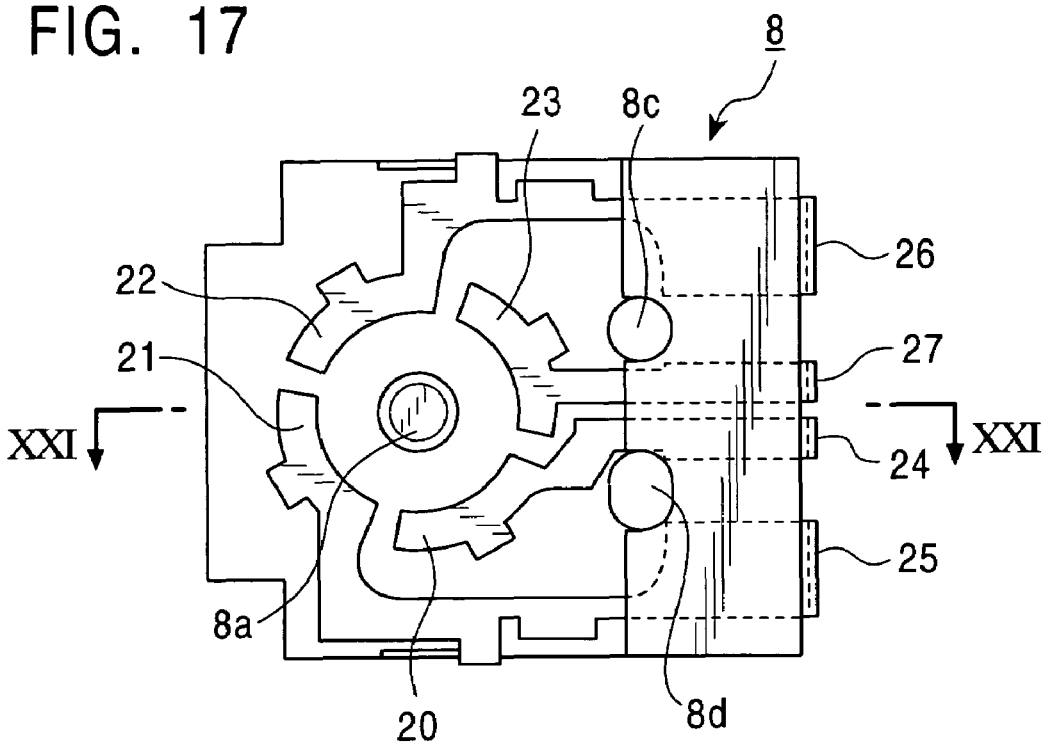
FIG. 17 is a plan view of a wafer provided with the push switch device.
Figure 18:
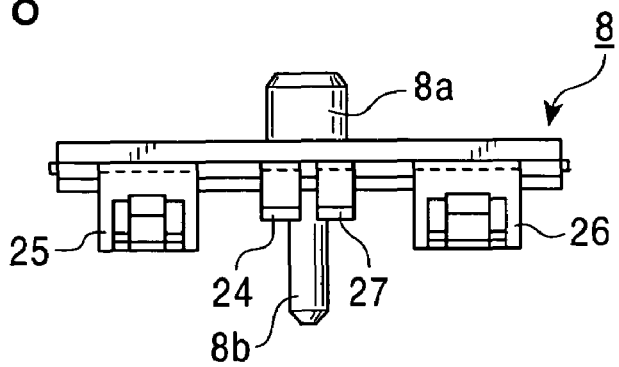
FIG. 18 is a front elevational view of the wafer.
Figure 19:
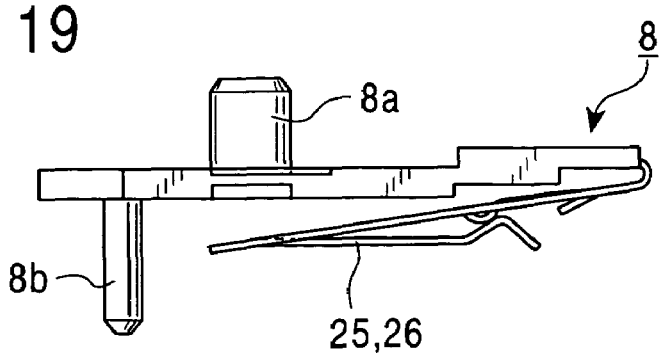
FIG. 19 is a side elevational view of the wafer.
Figure 20:
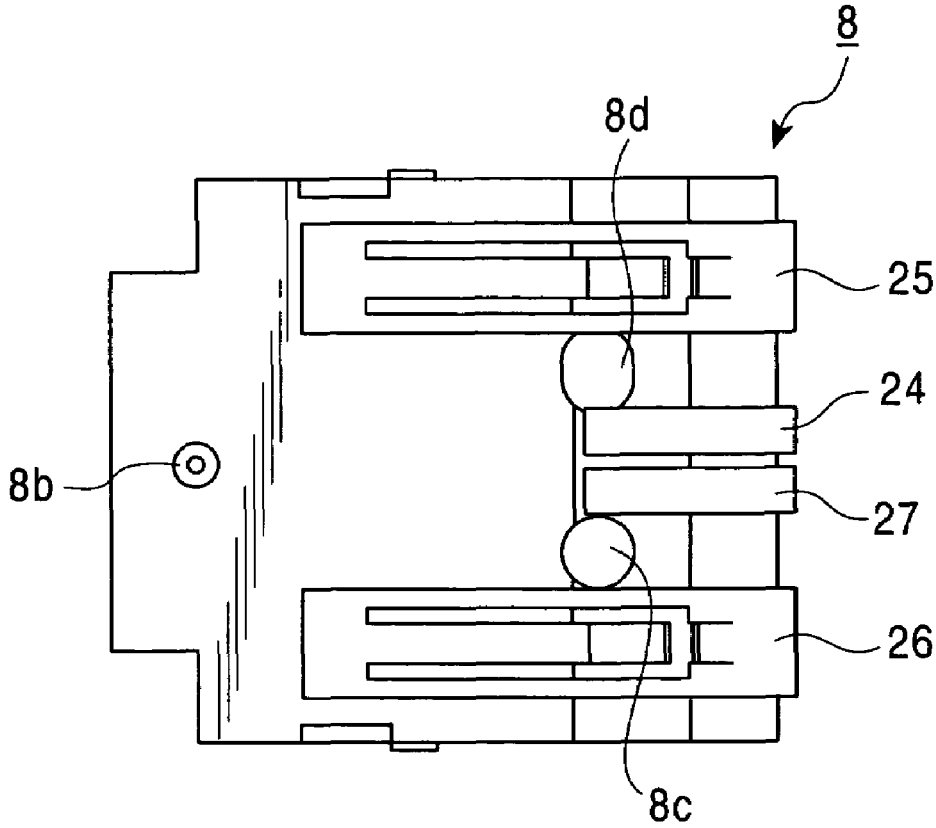
FIG. 20 is a bottom view of the wafer.
Figure 21:
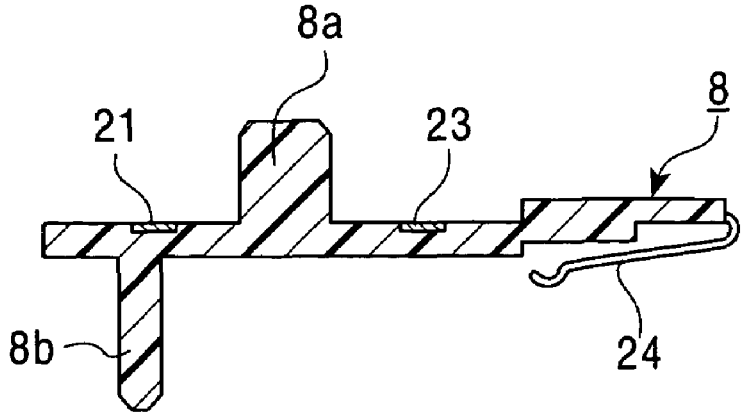
FIG. 21 is a sectional view of the wafer taken along the line XXI—XXI of FIG. 17.
Figure 22A:
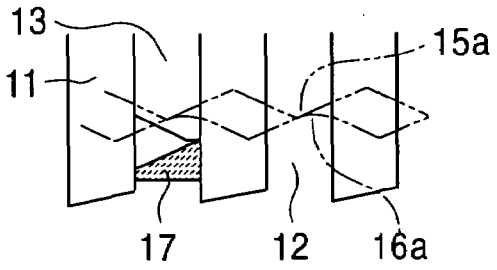
FIGS. 22A to 22G are views explaining the changes of phase of the first latchet tooth and the second latchet tooth.
Figure 23A:
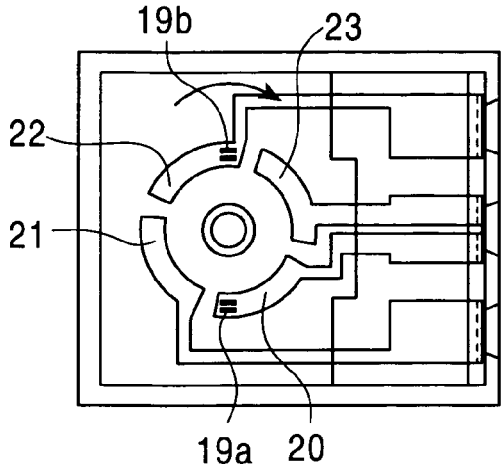
FIGS. 23A to 23E are views explaining the contacting/departing states of the movable contact element to respective stationary contact elements.
Figure 23B:
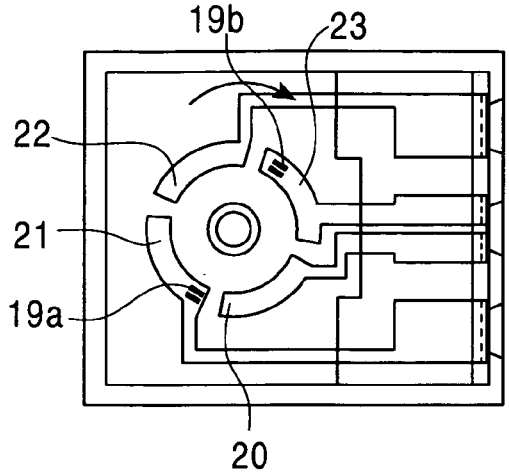
Figure 23C:
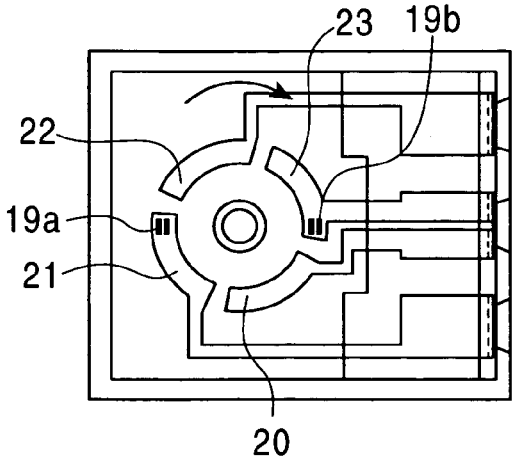
Figure 23D:
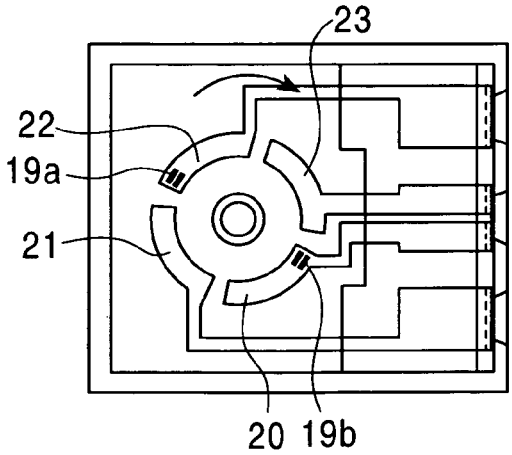
Figure 23E:
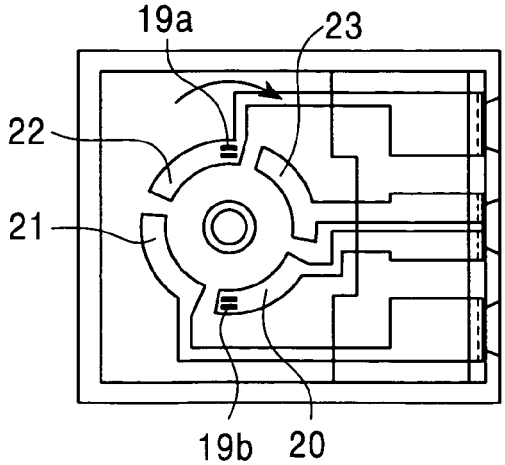
Figure 24:
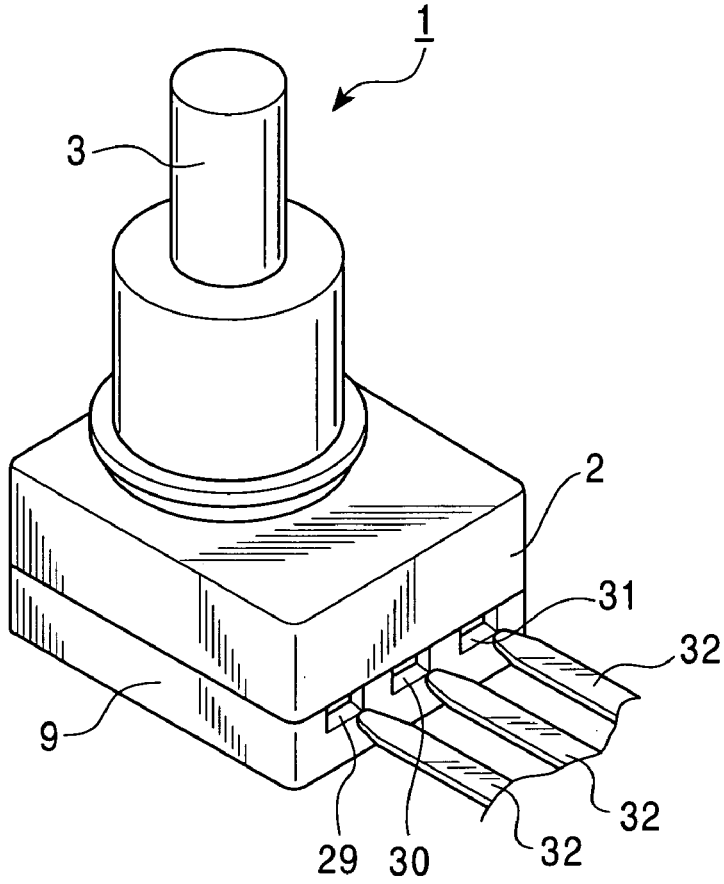
FIG. 24 is a perspective view showing the state that three external terminals are connected to the push switch device.
Figure 25:
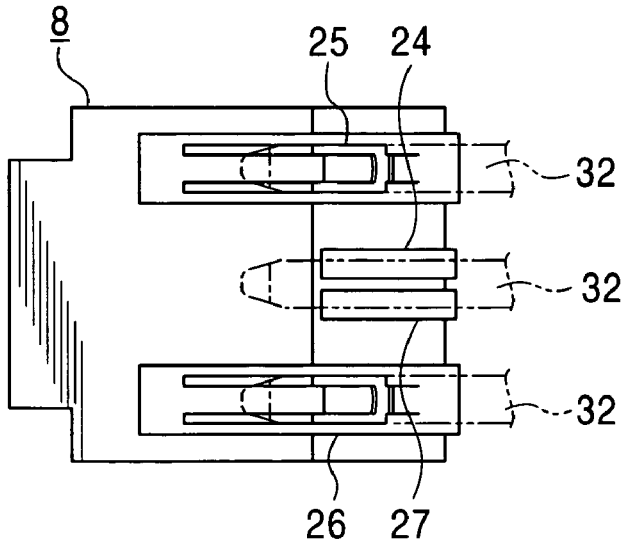
FIG. 25 is a view explaining the connecting state of the three external terminals to connector terminal groups.
Figure 26:
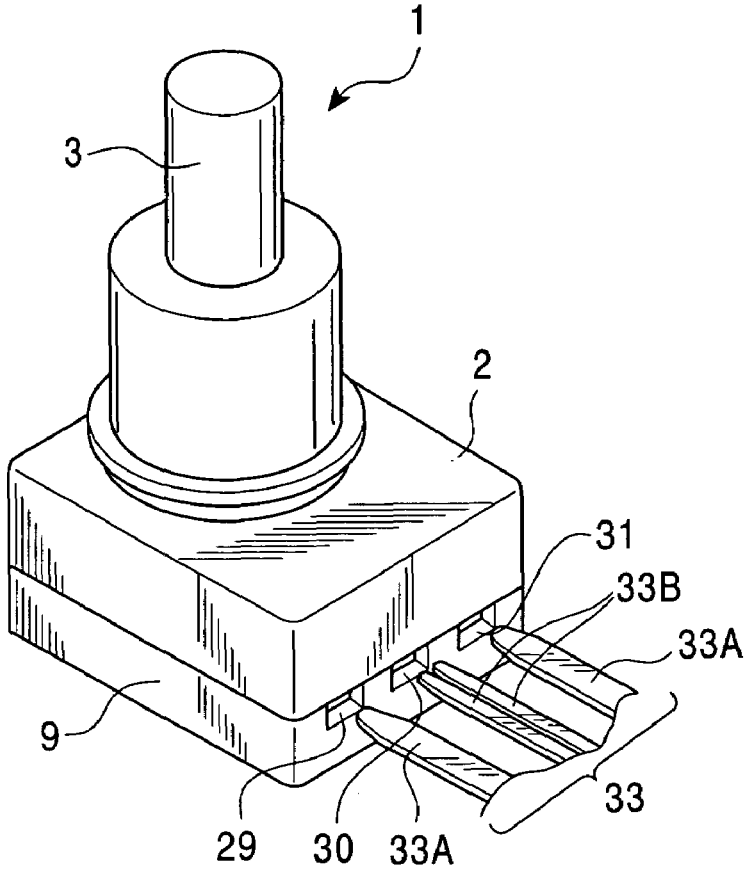
FIG. 26 is a perspective view showing the state that four external terminals are connected to the push switch device.
Figure 27:
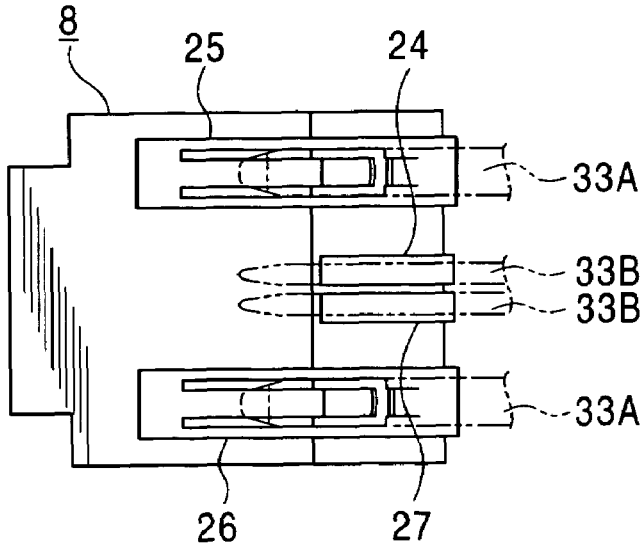
FIG. 27 is a view explaining the connecting state of the four external terminals to connector terminal groups.
Figure 28:
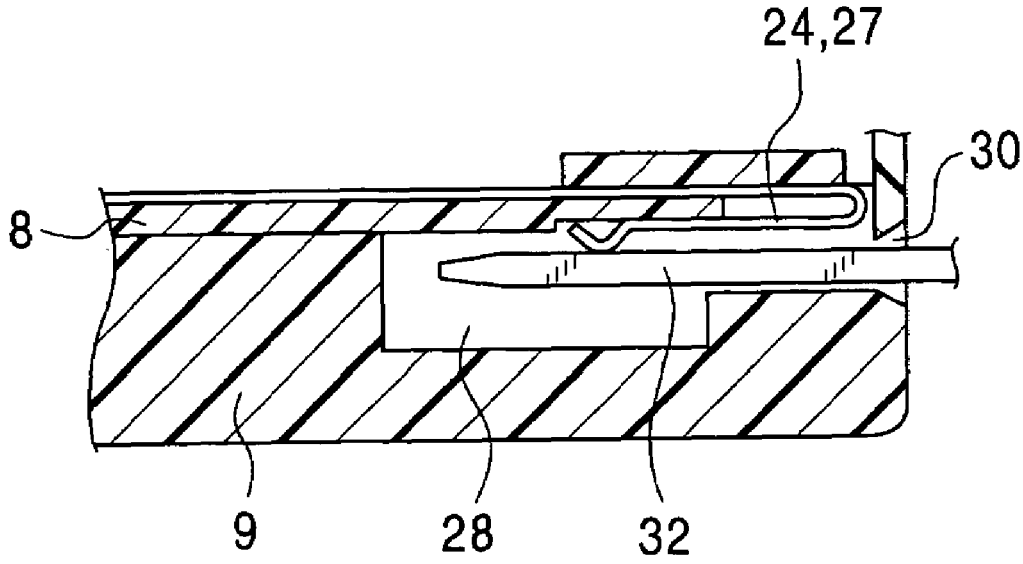
FIG. 28 is a sectional view showing the connecting state of an external terminal to a first connector terminal.
Figure 29:
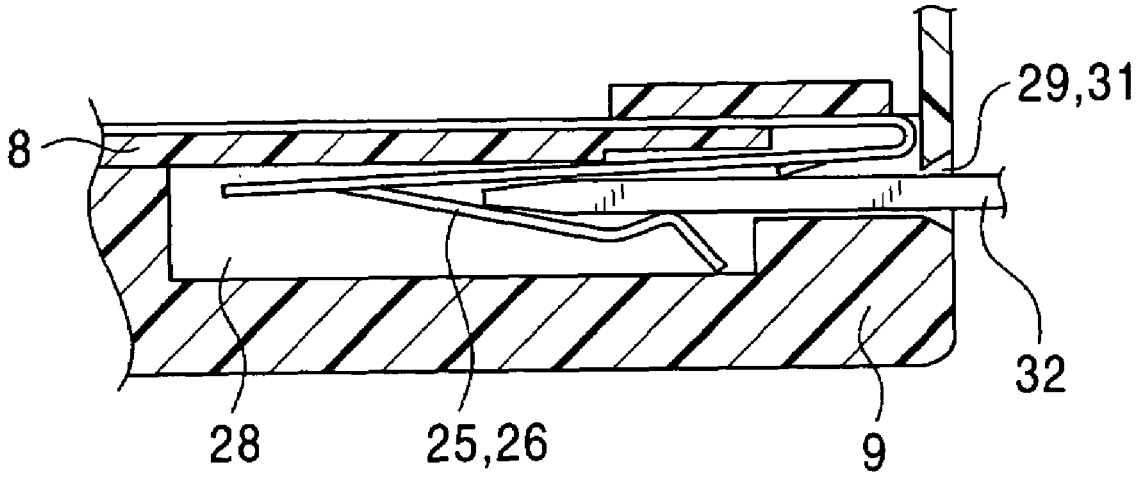
FIG. 29 is a sectional view showing a connecting state of the external terminal to the second connector terminal.
Figure 30A:
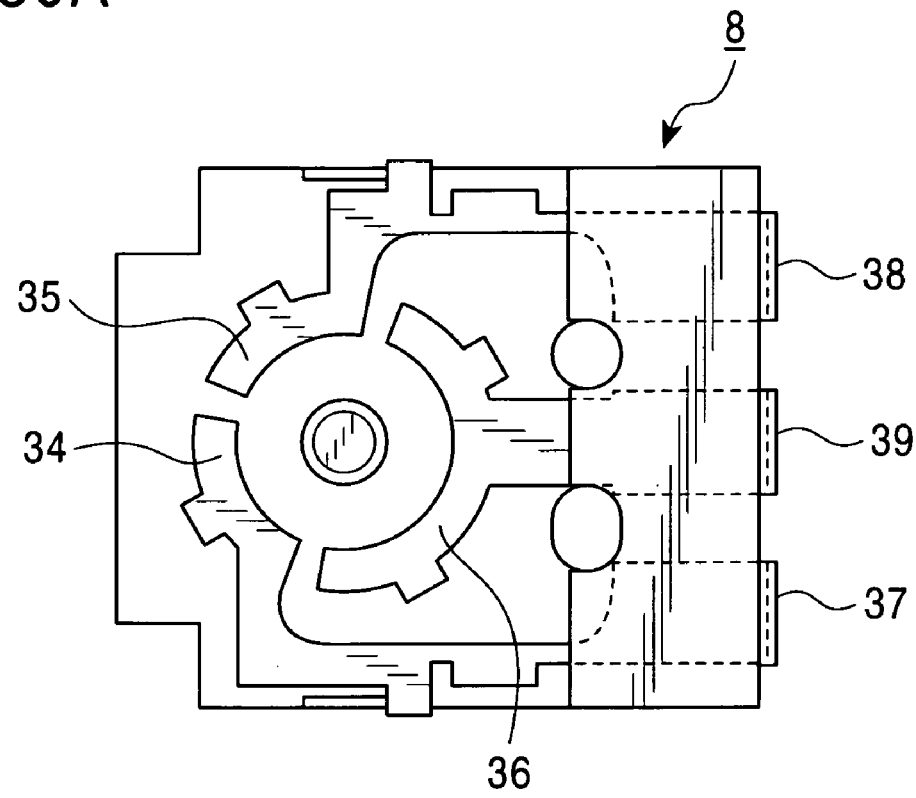
FIGS. 30A and 30B are plan views showing modifications of the wafer.
Figure 30B:
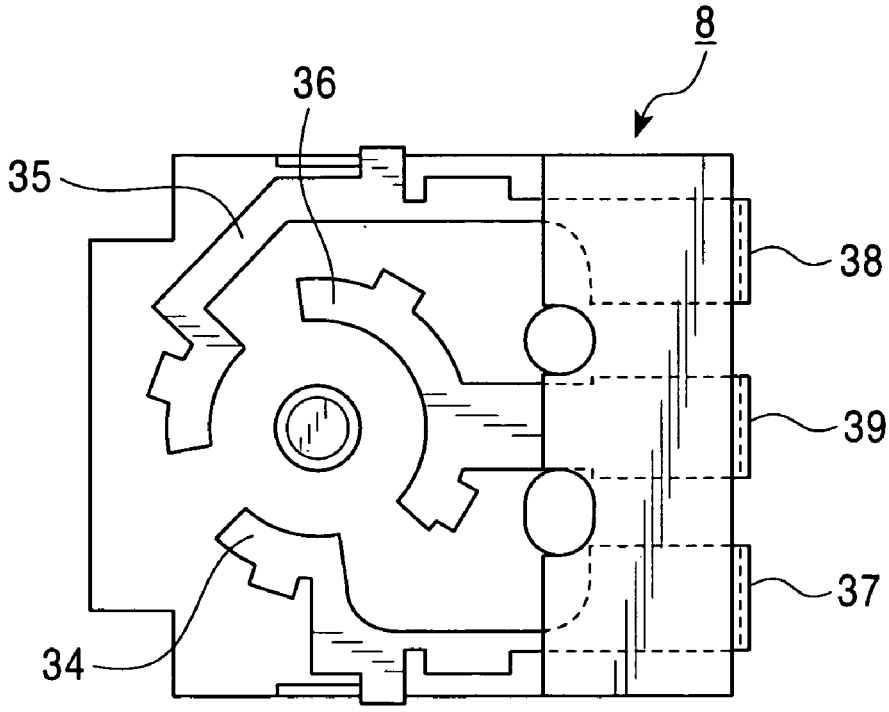

Embodiments of the present invention will be described with reference to the drawings. FIG. 1 is a front elevational view showing a push switch device according to an embodiment of the present invention; FIG. 2 is a sectional view showing a non-actuated state of the push switch device; FIG. 3 is a sectional view showing a pushed-state of the push switch device; FIG. 4 is an exploded perspective view of the push switch device; FIG. 5 is a plan view of a case provided with the switch device; FIG. 6 is a bottom view of the case; FIG. 7 is a sectional view of the push switch device taken along the line VII—VII of FIG. 5; FIG. 8 is a view of a guide portion formed to the case and explains the guide portion by developing it; FIG. 9 is a front elevational view of an actuation body of the push switch device; FIG. 10 is a bottom view of the actuation body; FIG. 11 is a view of a first latchet tooth formed to the actuation body and explains the latchet tooth by developing it; FIG. 12 is a plan view of a cam follower provided with the push switch device; FIG. 13 is a front elevational view of the cam follower; FIG. 14 is a bottom view of the cam follower; FIG. 15 is a view of a second latchet tooth formed to the cam follower and explains the latchet tooth by developing it; FIG. 16 is a plan view of a movable contact element provided with the push switch device; FIG. 17 is a plan view of a wafer provided with the push switch device; FIG. 18 is a front elevational view of the wafer; FIG. 19 is a side elevational view of the wafer; FIG. 20 is a bottom view of the wafer; FIG. 21 is a sectional view of the wafer taken along the line XXI—XXI of FIG. 17; FIGS. 22A to 22G are views explaining the changes of phase of the first latchet tooth and the second latchet tooth; FIGS. 23A to 23E are views explaining the contacting/departing states of the movable contact element to respective stationary contact elements; FIG. 24 is a perspective view showing the state that three external terminals are connected to the push switch device; FIG. 25 is a view explaining the connecting state of the three external terminals to connector terminal groups; FIG. 26 is a perspective view showing the state that four external terminals are connected to the push switch device; FIG. 27 is a view explaining the connecting state of the four external terminals to connector terminal groups; FIG. 28 is a sectional view showing the connecting state of an external terminal to a first connector terminal; FIG. 29 is a sectional view showing a connecting state of the external terminal to the second connector terminal; and FIGS. 30A and 30B are plan views showing modifications of the wafer.

As shown in FIGS. 1 to 4, the push switch device 1 according to the embodiment includes a case 2 having a hollow internal structure, an actuation body 3 that can rises and falls in the up/down direction of the case 2, a cam follower 4 that can be moved in a rotational direction and the up/down direction by the rising/falling movement of the actuation body 3, a first coil spring 5 interposed between the actuation body 3 and the cam follower 4 and acting as an elastic member, an actuating member 6 that is spline coupled with the cam follower 4 and can be rotated integrally with it, a second coil spring 7 interposed between the cam follower 4 and the actuating member 6 and acting as a return spring, a wafer 8 rotatably supporting the actuating member 6, and a cover 9 for closing the lower opening end of the case 2, and a housing 10 is composed of the case 2 and the cover 9.

The case 2 is molded of a synthetic resin material such as polybuthylene telephthalate (PBT) and the like and has a rectangular base 2*a* with its lower surface opened and a cylindrical portion 2*b* standing from the upper surface of the base 2*a* as shown in FIGS. 5 to 8. Four bosses 2*c* suspend downward from the inside of the base 2*a*, and a circular hole 2*d* is formed at the center on the upper surface of the cylindrical portion 2*b*. Four guide projections 11, which extend in an axial direction, are formed on the inner circumferential surface of the cylindrical portion 2*b* at equal intervals, and guide grooves 12 are formed between the respective guide projections 11. The guide projections 11 and the guide grooves 12 act as a guide portion for guiding the actuation body 3 in the up/down direction, and tapers 11*a* are formed the guide projections 11 at the lower end thereof.

The actuation body 3 is molded of an elastomer composed of a block copolymer and the like of PBT and polyether. Used in this embodiment is a thermoplastic polyester elastomer, and, more specifically, a thermoplastic elastomer whose commodity name is "Hytrel" (trademark of Du Point) made by Du Point-Toray Co. Ltd. As shown in FIGS. 9 to 11, the actuation body 3 is formed to have the hollow structure with its lower end opened and has an actuating portion 3*a* projecting outwardly from the circular hole 2*d* of the case 2 and a large diameter portion 3*b* projecting radially outwardly from the lower portion of the actuating portion 3*a*. Four projections 13 are formed around the outer circumferential surface of the large diameter portion 3*b* at equal intervals, and recesses 14 are formed between the respective projections 13. The projections 13 are inserted into the guide grooves 12 of the case 2, the recesses 14 are fitted on the guide projections 11 thereof, and the actuation body 3 is guided by the guide portion composed of the guide projections 11 and the guide grooves 12 such that it can rise and fall only in the up/down direction as described above. Further, a first latchet tooth 15, which extends along a circumferential direction, is formed at the lower end of the large diameter portion 3*b* and has four ridge portions 15*a* and four valley portions 15*b* that alternately continue in the circumferential direction. Note that the respective ridge portions 15*a* are located at the centers of the projections 13 in the circumferential direction thereof, and the respective valley portions 15*b* are located at the centers of the recesses 14 in the circumferential direction thereof.

The cam follower 4 is molded of a synthetic resin material (plastomer) such as polyacetal (POM) excellent in slidability and arranged as a cylindrical body having a hollow structure with its lower end opened. The upper portion of the cam follower 4 is rotatably and upward and downward movably inserted into the large diameter portion 3*b* of the actuation body 3, and the first coil spring 5 is in elastic contact with the upper surface of the cam follower 4 and with the inner top surface of the actuation body 3 at both the ends thereof. As shown in FIGS. 12 to 15, a second latchet tooth 16, which extends along the circumferential direction, is formed on the outer circumferential surface of the cam follower 4 and has four ridge portions 16*a* and four valley portions 16*b* that alternately continue in the circumferential direction. The second latchet tooth 16 is engaged with the first latchet tooth 15 formed at the lower end of the actuation body 3. Although the first and second latchet teeth 15 and 16 are formed in approximately the same shape, only the extreme ends (apexes) of the ridge portions 16*a* of the second latchet tooth 16 are formed in an arc shape. Further, four cam projections 17 are formed on the outer circumferential surface of the cam follower 4 at equal intervals, and tapers 17*a* are formed to the cam projections at the upper ends thereof. As apparent from FIG. 15, the respective cam projections 17 are somewhat offset in the circumferential direction with respect to the ridge portions 16*a* of the second latchet tooth 16. In contrast, four engaging projections 18 are formed around the inner circumferential surface of the cam follower 4 at equal intervals and positioned at the centers in the circumferential direction with respect to the cam projections 17.

The actuating member 6 is molded of the synthetic resin material (plastomer) such as polyacetal (POM) excellent in slidability and has a cylindrical portion 6*a* with its upper end opened and a disc portion 6*b* projecting radially outwardly from the lower end of the cylindrical portion 6*a*. Four slits 6*c*, which extend in the axial direction, are formed to the cylindrical portion 6*a* which is inserted into the cam follower 4 through the second coil spring 7. At this time, when the respective slits 6*c* are inserted into the engaging projections 18 and spline coupled therewith, the actuating member 6 is rotated integrally with the cam follower 4 in association therewith without preventing the upward/downward movement of the cam follower 4. The spring load of the second coil spring 7 interposed between the actuating member 6 and the cam follower 4 is set to a value that is sufficiently larger than that of the first coil spring 5 interposed between the cam follower 4 and the actuation body 3. That is, both the minimum and maximum loads of the second coil spring 7 are set sufficiently larger than those of the first coil spring 5. Accordingly, the second latchet tooth 16 is meshed with the first latchet tooth 15 by urging the cam follower 4 upward by imparting the spring force of the second coil spring 7 to the cam follower 4. Further, a movable contact element 19 is attached to the back surface of the disc portion 6*b* by means of thermal caulking and the like as well as a circular guide hole 6*d* is formed at the center of the actuating member 6. As shown in FIG. 16, the movable contact element 19 is formed in an approximately annular shape, and two sets of contact portions 19*a* and 19*b* are formed to the movable contact element 19 the diametrically opposite positions thereof.

The wafer 8 is molded of the synthetic resin material such as PBT and the like. As shown in FIGS. 17 to 21, a columnar boss 8*a* stands on the upper surface of the wafer 8, and a columnar positioning pin 8*b* is suspend from the back surface thereof. The boss 8*a* acts as the fulcrum of rotation of the actuating member 6, and the guide hole 6*d* of the actuating member 6 is rotatably fitted on the boss 8*a*. A circular through-hole 8*c* and an oval through-hole 8*d* are formed through the wafer 8, the two bosses 2*c* of the four bosses 2*c* projecting from the base 2*a* of the case 2 extend to the back surface of the wafer 8 passing through these through-holes 8*c* and 8*d*, and the remaining two bosses 2*c* extend to the back surface of the wafer 8 passing through the cutouts at both the corners of the wafer 8. Four stationary contact elements 20, 21, 22, 23 are exposed on the upper surface of the wafer 8 and have connector terminals 24, 25, 26, 27 derived from the wafer 8. The stationary contact elements 20, 21, 22, 23 and the connector terminals 24, 25, 26, 27 are composed of an elastic metal sheet composed of Ag-plated phosphor bronze and the like and arranged integrally with the wafer 8 using an insert molding technology. The respective stationary contact elements 20, 21, 22, 23 are disposed concentrically about the boss 8*a* at predetermined intervals. As described later, when the actuating member 6 is rotated about the boss 8*a*, the contact portions 19*a* and 19*b* of the movable contact element 19 rotatingly slide on the stationary contact elements 20, 21, 22, 23.

Further, the four connector terminals 24, 25, 26, 27, which act as female type terminals to male type external terminals to be described later, are folded back from an end surface of the wafer 8 to the back surface thereof, and the width and the length of the two connector terminals 24 and 27, which are located adjacent to each other at a center, are set smaller than those of the remaining two connector terminals 25 and 26 located on both the sides of them. For convenience, when the two connector terminals 24 and 27 located at the center are called first and fourth connector terminals 24 and 27, respectively, and the connector terminals 25 and 26 on the both sides are called second and fourth connector terminals 25 and 26, respectively, first and fourth connector terminals 24 and 27 are formed in a cantilever state, and the second and third connector terminals 25 and 26 are formed in a clip shape.

The cover 9 is formed of the synthetic resin material such as PBT and the like and formed in the same shape as the base 2*a* of the case 2 when viewed in a plane as shown in FIGS. 1 to 4. A plurality of transparent holes 9*a* are formed through the cover 9, and the respective bosses 2*c* of the case 2 and the positioning pin 8*b* of the wafer 8 are inserted into the transparent holes 9*a* and thermally caulked at the extreme ends thereof, thereby the wafer 8 is positioned and clamped between the case 2 and the cover 9 as well as the housing 10 is formed by integrating the case 2 and the cover 9 together. Further, a recessed portion 28 is formed on the inner bottom surface of the cover 9, and the respective connector terminals 24, 25, 26, 27, which are folded back to the back surface of the wafer 8, are accommodated in the recessed portion 28 such that they can be deformed. Further, three insertion ports 29, 30, 31, which communicate with the recessed portion 28, are formed on a side of the cover 9. For convenience, when the insertion port located at a center is called a first insertion port 30, and the insertion ports located on both the sides of the first insertion port 30 are called second and third insertion ports 29 and 30, respectively, the first and fourth connector terminals 24 and 27 are disposed in the first insertion port 30 in proximity to each other, the second connector terminal 25 is disposed on a line extending from the second insertion port 29, and the third connector terminal 26 is disposed on a line extending from the third insertion port 31. Further, tapers are formed to the peripheral edges (partition members) of the respective insertion ports 29, 30, 31 so that external terminals, which will be described later, can be smoothly inserted. Note that the partition members for partitioning the plurality of insertion ports 29, 30, 31 may be formed integrally with the wafer 8 on the lower surface thereof.

Next, the operation of the push switch device 1 arranged as described above will be described with reference to FIGS. 22 and 23. Although the only one cam projection 17 is shown in FIGS. 22A to 22G to assist easy understanding, the cam projections 17 other than it also operate likewise.

FIG. 2 shows a non-operating state in which no external force acts on the actuating portion 3*a* of the actuation body 3. In this non-operating state, the actuation body 3 and the cam follower 4 are urged to a rising position by the spring force of the second coil spring 7, and the respective projections 13 of the actuation body 3 and the cam projections 17 of the cam follower 4 are engaged with the guide grooves 12 of the case 2. Accordingly, the cam follower 4 can be moved only in the axial direction because the movement thereof in the rotational direction is regulated. At this time, since the first latchet tooth 15 formed to the actuation body 3 is engaged with the second latchet tooth 16 formed to the cam follower 4 at an unstable position, the phase relationship between the ridge portions 16*a* of the second latchet tooth 16 and the ridge portions 15*a* of the first latchet tooth 15 is such that the ridge portions 16*a* are slightly offset from the ridge portions 15*a* as shown in FIG. 22A.

Figure 22B:
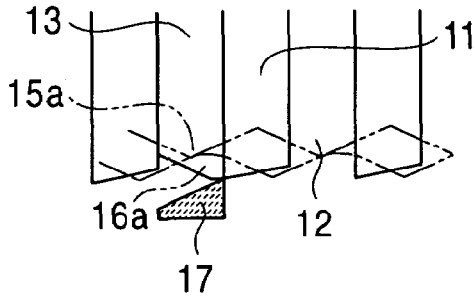

When the actuating portion 3*a* of the actuation body 3 is pushed directly or through a not shown actuator, first, the cam projections 17 of the cam follower 4 fall in the guide grooves 12 of the case 2 together with the projections 13 of the actuation body 3, and the cam projections 17 reach the lower end positions of the guide projections 11 adjacent to the guide grooves 12 as shown in FIG. 22B. During the above operation, since the movement of the cam follower 4 in the rotational direction is regulated and the spring load of the first coil spring 5 interposed between the actuation body 3 and the cam follower 4 is not changed, the actuation body 3 and the cam follower 4 fall against the spring force of the second coil spring 7, thereby an initial push force necessary to the actuation body 3 is secured by the spring force of the second coil spring 7. Further, since the engaging projections 18 of the cam follower 4 are spline coupled with the slits 6*c* of the actuating member 6, the engaging projections 18 fall in the slits 6*c* as the cam follower 4 falls.

Figure 22C:
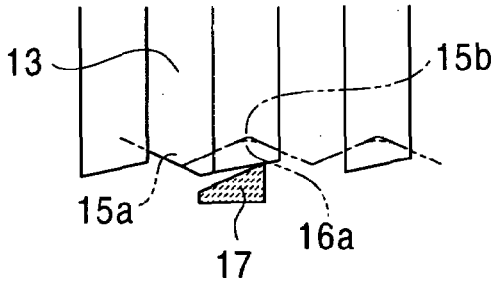

When the actuating portion 3*a* of the actuation body 3 is further pushed, the cam projections 17 are released from the lower ends of the guide projections 11, and the regulation of movement in the rotational direction of the cam follower 4 is removed as shown in FIG. 22C. Thus, the ridge portions 16*a* of the second latchet tooth 16 move from the ridge portions 15*a* of the first latchet tooth 15 to the valley portions 15*b* thereof. Accordingly, the phase relationship between the first and second latchet teeth 15 and 16 changes such that they shift to a stable position at which the ridge portions 15*a* and 16*a* thereof are engaged with the valley portions 16*b* and 15*b* corresponding to them respectively. With this operation, the cam follower 4 is rotated by an angle (about 35°) slightly smaller than 45° that is one half the ridge of first and second latchet teeth 15 and 16 as well as the actuating member 6, which is spline coupled with the cam follower 4, is also rotated in association with the rotation of the cam follower 4. When the actuating portion 3*a* of the actuation body 3 is further pushed, the actuation body 3 and the cam follower 4 fall integrally with each other while keeping the stable phase relation between the first and second latchet teeth 15 and 16 as shown in FIG. 22D and reach a stroke end position at which the actuating portion 3*a* of the actuation body 3 cannot be further pushed.

Figure 22D:
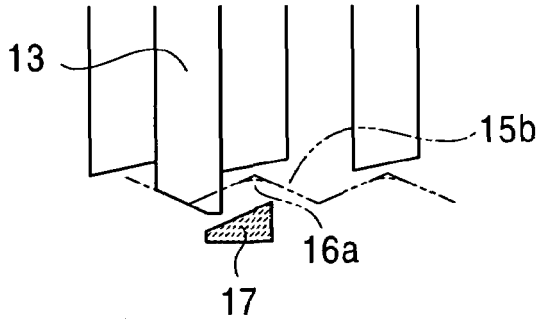
Figure 22E:
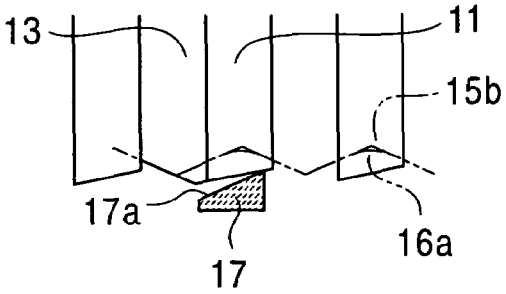
Figure 22F:
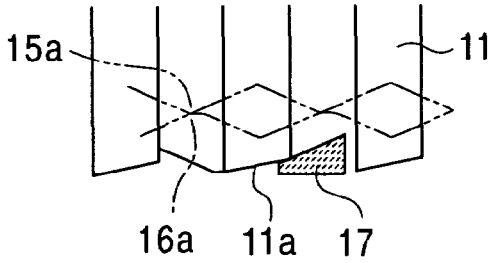
Figure 22G:
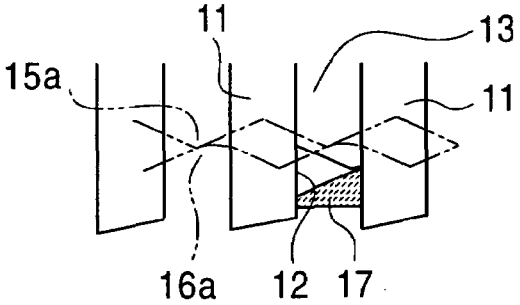

When the push force acting on the actuating portion 3*a* of the actuation body 3 is released therefrom at the stroke end position shown in FIG. 22D, the actuation body 3 and the cam follower 4 are caused to rise by the spring force of the second coil spring 7 as shown in FIG. 22E, thereby the cam projections 17 of the cam follower 4 are abutted against the lower ends of the guide projections 11. The tapers 11*a* are formed to the lower ends of the guide projections 11, and the tapers 17*a*, which have a taper angle different from that of the tapers 11*a* (that is, the tapers 17*a* have an acute angle with respect to an imaginary line parallel with the axial line of the actuation body 3), are also formed to the upper ends the cam projections 17. Accordingly, the cam projections 17 move along the lower ends of the guide projections 11 in approximately line contact therewith as shown in FIG. 22F and then enter the guide grooves 12 as shown in FIG. 22G to thereby rotate the cam follower 4. Therefore, the phase relationship between the first and second latchet teeth 15 and 16 shifts from the stable position to the unstable position. That is, after the ridge portions 16*a* of the second latchet tooth 16 move from the valley portions 15*b* of the first latchet tooth 15 to the valley portions 15*b* thereof as shown in FIG. 22F, the ridge portions 16*a* of the second latchet tooth 16 get over the ridge portions 15*a* of the first latchet tooth 15 as shown in FIG. 22G, thereby the phase relationship between the first and second latchet teeth 15 and 16 is set to the same phase relationship as that of the initial position shown in FIG. 22A.

That is, as the actuation body 3 is pushed and released once, the cam follower 4 is rotated by one ridge of the first and second latchet teeth 15 and 16, and the actuating member 6 is also rotated by the same amount in association with the rotation of the cam follower 4. In this embodiment, the first and second latchet teeth 15 and 16 have the four ridge portions 15*a* and 16*a* and the four valley portions 15*b* and 16*b*, respectively. Accordingly, when the actuation body 3 is pushed and released once, the cam follower 4 and the actuating member 6 are rotated 90°, and thereafter they are rotated each 90° in the same direction as the actuation body 3 is pushed and released repeatedly.

Note that since the cam follower 4 is molded of the synthetic resin material (plastomer) excellent in slidability, when the cam projections 17 move along the lower ends (tapers 11*a*) of the guide projections 11 from the state shown in FIG. 22E, the cam projections 17 smoothly slide along the tapers 11*a* of the guide projections 11 without being caught by them, thereby the cam projections 17 can be securely entered into the guide grooves 12. Although it is a mater of course, the tapers 11*a* and 17*a* incline so as to be rotated by the spring force of the second coil spring 7 in the same direction as that they are rotated from the state shown in FIG. 22B to the state shown in FIG. 22C, so that the tapers 11*a* and 17*a* can shift to the state shown in FIG. 22G.

The actuating member 6 is rotated by pushing and releasing the actuation body 3 as described above, which can change the contact states between contact portions 19*a* and 19*b* of the movable contact element 19 attached to the actuating member 6 and the respective stationary contact elements 20, 21, 22, 23 on the wafer 8. For example, as shown in FIG. 23A, it is assumed that the sate, in which the contact portion 19*a* of the movable contact element 19 comes into contact with the stationary contact element 20 at an upstream position thereof as well as the other contact portion 19*b* thereof comes into contact with the stationary contact element 22 at an upstream position thereof, is defined as the initial position corresponding to FIG. 22A. In this initial state, the first connector terminal 24 derived from the stationary contact element 20 is brought into electric conduction with the third connector terminal 26 derived from the stationary contact element 22 through the movable contact element 19, and the second and fourth connector terminal 25 and 27 derived from the remaining stationary contact element 21 and 23 are brought out of electric conduction therebetween.

When the actuation body 3 is pushed to the stroke end position shown in FIG. 22(*d*), the actuating member 6 is rotated by an angle (about 35°) slightly smaller than one half the ridge of first and second latchet teeth 15 and 16 (45°). Accordingly, as shown in FIG. 23B, the contact portion 19*a* departs from the stationary contact element 20 and comes into contact with the stationary contact element 21 at an downstream position thereof as well as the other contact portion 19*b* departs from the stationary contact element 22 and comes into contact with the stationary contact element 23 at an downstream position thereof. With the above operation, the first and third connector terminals 24 and 26 derived from both the stationary contact elements 20 and 22 are brought out of electric conduction therebetween, and the second connector terminal 25 derived from the stationary contact element 21 is brought into electric conduction with the fourth connector terminal 27 derived from the stationary contact element 23 through the movable contact element 19.

Thereafter, when the actuation body 3 is returned to the non-operation state shown in FIG. 22G by releasing the push force acting thereon, the actuating member 6 is rotated by an angle (about 55°) lightly larger than one half the ridge of first and second latchet teeth 15 and 16 (45°), that is, by one ridge (90°) based on the initial position. Accordingly, as shown in FIG. 23C, the contact portion 19*a* slidingly rotates from the downstream position of the stationary contact element 21 to the upstream position thereof as well as the other contact portion 19*b* slidingly rotates from the downstream position of the stationary contact element 23 to the upstream position thereof. Therefore, the non-electric-conduction state is maintained between the first and third connector terminals 24 and 26 as well as the electric conduction state is maintained between the second and fourth connector terminals 25 and 27.

Subsequently, when the actuation body 3 is pushed to the stroke end position again, the actuating member 6 is rotated by an angle (about 35°) slightly smaller than the one half the ridge of first and second latchet teeth 15 and 16 (45°), that is, an angle (about 125°) slightly smaller than 3/2 ridge (135°) based on the initial position. Accordingly, the contact portion 19*a* departs from the stationary contact element 21 and comes into contact with the stationary contact element 22 at the downstream position thereof as well as the other contact portion 19*b* departs from the stationary contact element 23 and comes into contact with the stationary contact element 20 at a downstream position thereof. With the above operation, the first connector terminal 24 is brought into electric conduction with the third connector terminal 26 through the movable contact element 19 as well as the second and the fourth connector terminals 25 and 27 are brought out of electric conduction therebetween.

Likewise, when the actuation body 3 is returned to the non-operation state by releasing the push force acting thereon, the actuating member 6 is rotated by an angle (about 55°) lightly larger than one half the ridge of first and second latchet teeth 15 and 16 (45°), that is, by two ridges (180°) based on the initial position. Accordingly, as shown in FIG. 23E, the contact portion 19*a* slidingly rotates from the downstream position of the stationary contact element 20 to the upstream position thereof as well as the other contact portion 19*b* slidingly rotates from the downstream position of the stationary contact element 22 to the upstream position thereof. Therefore, the electric-conduction state is maintained between the first and third connector terminals 24 and 26 as well as the non-electric-conduction state is maintained between the second and fourth connector terminals 25 and 27.

Note that, as described above, the respective stationary contact elements 20, 21, 22, 23 are formed in the arc shape and explained above by defining for convenience that the portions thereof located in a clockwise direction are the upward positions and the portions thereof located in a counterclockwise direction are the downstream positions.

As apparent from the above explanation, in the push switch device 1 according to the embodiment, the contact portions 19*a* and 19*b* of the movable contact element 19 come into contact with and depart from the respective stationary contact elements 20, 21, 22, 23 by repeatedly pushing the releasing the actuation body 3. When, however, the stationary contact elements 20 and 23, which are in electric conduction with the first and fourth connector terminals 24 and 27, are examined, any one of the contact portions 19*a* and 19*b* of the movable contact element 19 is in a contact state at all times, thereby three external terminals and four external terminals can be selectively connected to the push switch device 1.

That is, as shown in FIGS. 24 and 25, when three external terminals 32 all of which have the same width are prepared and inserted into the inside of the cover 9 through the three insertion ports 29, 30, 31 formed to the cover 9, respectively, the external terminal 32 inserted into the first insertion port 30 at a center is in electric conduction with the first and fourth connector terminals 24 and 17 in the cover 9 as shown in FIG. 28, and the two external terminals 32 inserted into the second and third insertion ports 29 and 31 on both sides of the insertion port 30 are in electric conduction with the second and third connector terminals 25 and 26 in the cover 9, respectively. Accordingly, in this case, the stationary contact elements 20 and 23 acts as a single common stationary contact element, so that the push switch device 1 can be used as a push switch device having a one-circuit/two-contact elements structure.

In contrast, as shown in FIGS. 26 and 27, when four external terminals 33, which are composed of two external terminals 33B having a width smaller than that of two external terminals 33A located on both the sides of them, are prepared, both the external terminals 33A are inserted into the second and third insertion ports 29 and 31, respectively as well as the two external terminals 33B are inserted into the first insertion port 30, the four external terminals 33 are in electric conduction with the first to fourth connector terminals 24, 25, 26, 27 which correspond thereto, independently. Accordingly, in this case, all the stationary contact elements 20, 21, 22, and 23 act as switching stationary contact elements, thereby the push switch device 1 can be used as a push switch device having a two-circuits/two-contact elements structure.

As described above, in the push switch device 1 according to this embodiment, since the first coil spring 5, which has the spring load smaller than that of the second coil spring 7, is interposed between the actuation body 3 and the cam follower 4, when the phase of the ridge portions 16*a* of the second latchet tooth 16 is shifted to the stable position by pushing the actuation body 3, that is, when the phase relationship between the first and second latchet teeth 15 and 16 is shifted from the position shown in FIG. 22B to the position shown by FIG. 22C, the first coil spring 5 acts in a direction where the spring force of the second coil spring 7 is reduced, thereby the noise generated when the ridge portions 16*a* of the second latchet tooth 16 are abutted against the valley portions 15*b* of the first latchet tooth 15 is reduced. Further, when the phase of the ridge portions 16*a* of the second latchet tooth 16 is shifted from the stable position to the unstable position by releasing the actuation body 3, that is, when the phase relationship between the first and second latchet teeth 15 and 16 is shifted from the position shown in FIG. 22E to the position shown in FIG. 22G, since the first coil spring 5 also acts in the direction where the spring force of the second coil spring 7 is reduced, the ridge portions 16*a* of the second latchet tooth 16 smoothly move from the valley portions 15*b* of the first latchet tooth 15 to the ridge portions 15*a* thereof, thereby the kick noise generated when the ridge portions 16*a* get over the ridge portions 15*a* is reduced. Therefore, the abutment noise of the first and second latchet teeth 15 and 16 can be reduced while securing the initial push force necessary to the actuation body 3.

Moreover, since the first latchet tooth 15 is formed to the actuation body 3 composed of the elastomer and the second latchet tooth 16 is formed to the cam follower 4 composed of the synthetic resin (plastomer), the abutment noise can be more effectively reduced when the phase of the ridge portions 16*a* of the second latchet tooth 16 is shifted to the stable position as the actuation body 3 is pressed and when the phase of the ridge portions 16*a* of the second latchet tooth 16 is shifted from the stable position to the unstable position as the actuation body 3 is released. Further, since the second latchet tooth 16 is composed of the material excellent in slidability, the wear of the first latchet tooth 15 composed of the elastomer can be reduced. Further, since the extreme ends (apexes) of the ridge portions 16*a* of the second latchet tooth 16 are rounded in the arc shape, when the phase of the ridge portions 16*a* of the second latchet tooth 16 is shifted from the stable position to the unstable position as the actuation body 3 is released, the ridge portions 16*a* of the second latchet tooth 16 can smoothly get over the ridge portions 15*a* of the first latchet tooth 15, by which the abutment noise of the first and second latchet teeth 15 and 16 can be also reduced.

Further, in the push switch device 1 according to this embodiment, the wafer 8 accommodated in the housing 10 is provided with the four stationary contact elements 20, 21, 22, 23 and the connector terminals 24, 25, 26, 27 derived from the respective stationary contact elements 20, 21, 22, 23, and the two connector terminals 24 and 27 of these connector terminals 24, 25, 26, 27, which are connected to the stationary contact elements 20 and 23 that are alternately brought into electric conduction with the movable contact element 19 as the actuation body 3 is actuated, are disposed in the common insertion port 30 adjacent to each other as well as the remaining two connector terminals 25 and 26 are independently disposed in the two insertion ports 29 and 31. Accordingly, the external terminal 32 inserted through the common insertion port 30 can be simultaneously brought into electric conduction with the two connector terminals 24 and 27, and the two external terminals 33B inserted through the common insertion port 30 can be independently brought into electric conduction with the two connector terminals 24 and 27. That is, since the two stationary contact elements 20 and 23 of the our stationary contact elements 20, 21, 22, 23 act as the common stationary contact element or the individual switching stationary contact elements, it is possible to selectively derive ON/OFF signals from the respective stationary contact elements 20, 21, 22, 23 so that they can be used for one circuit and two circuits, which permits the versatility in use of the push switch device 1 to be increased.

Note that, in the above embodiment, there has been explained the push switch device of the type in which the movable contact element 19 is attached to the actuating member 6 that is rotated in association with the rotation of the cam follower 4 as well as the respective stationary contact elements 20, 21, 22, 23 are disposed to the wafer 8 that rotatably supports the actuating member 6, and the actuating member 6 directly actuates the contact element switching mechanism. However, the embodiment may be provided with, for example, a power conversion mechanism for converting the rotating motion of the actuating member into a linear motion, and the actuating member may actuate the contact element switching mechanism through the power conversion mechanism.

Further, in the above embodiment, there has been explained the push switch device which can be selectively used as the one-circuit/two contact elements push switch device and the two-circuits/two contact elements push switch device by disposing the four stationary contact elements 20, 21, 22, 23 to the wafer 8 and causing the two stationary contact elements 20 and 23 to act as the one common stationary contact element or the individually switching stationary contact elements. It is a matter of course, however, that the push switch device can be applied to a push switch device dedicated for one-circuit/two contact elements. In this case, as shown in FIGS. 30A and 30B, two stationary contact elements 34 and 35 and one common stationary contact element 36 are exposed on the upper surface of the wafer 8 as well as three connector terminals 37, 38, 39 connected to the respective stationary contact elements 34, 35, 36 are derived from the wafer 8.

Further, in the above embodiment, there has been explained the case that only the extreme ends of the ridge portions 16*a* of the second latchet tooth 16 formed of the synthetic resin are rounded in the arc shape. However, when the extreme ends of the ridge portions 15*a* of the first latchet tooth 15 are also rounded in the arc shape, the abutment noise generated between the first and second latchet teeth 15 and 16 can be more reduced.

What is claimed is:

1. A push switch device comprising:

a housing arranged in a hollow structure and having a guide portion formed on an inner surface;

an actuation body which is configured to be moved in an axial direction by being guided by the guide portion and to which a first latchet tooth is formed so as to extend in a circumferential direction;

a cam follower which is disposed in the housing so as to rotate as well as to move in an axial direction and to which a second latchet tooth is formed so as to be engaged with the first latchet tooth;

a return spring for elastically urging the cam follower in the axial direction so that the first latchet tooth is engaged with the second latchet tooth;

a rotatable actuating member spline coupled with the cam follower; and a contact element switching mechanism actuated by the rotation of the actuating member, wherein at least one of the actuation body and the cam follower is formed of an elastomer, and wherein the actuation body is formed of the elastomer as well as the cam follower is formed of a plastomer whose elasticity is lower than that of the elastomer.

2. A push switch device comprising:

a housing arranged in a hollow structure and having a guide portion formed on an inner surface;

an actuation body which is configured to be moved in an axial direction by being guided by the guide portion and to which a first latchet tooth is formed so as to extend in a circumferential direction;

a cam follower which is disposed in the housing so as to rotate as well as to move in an axial direction and to which a second latchet tooth is formed so as to be engaged with the first latchet tooth;

a return spring for elastically urging the cam follower in the axial direction so that the first latchet tooth is engaged with the second latchet tooth;

a rotatable actuating member spline coupled with the cam follower; and a contact element switching mechanism actuated by the rotation of the actuating member, wherein at least the extreme ends of the tooth portions of one of the first and second latchet teeth are formed in an arc shape.

3. A push switch device comprising:

a housing arranged in a hollow structure and having a guide portion formed on an inner surface;

an actuation body which is configured to be moved in an axial direction by being guided by the guide portion and to which a first latchet tooth is formed so as to extend in a circumferential direction;

a cam follower which is disposed in the housing so as to rotate as well as to move in an axial direction and to which a second latchet tooth is formed so as to be engaged with the first latchet tooth;

a return spring for elastically urging the cam follower in the axial direction so that the first latchet tooth is engaged with the second latchet tooth;

a rotatable actuating member spline coupled with the cam follower; and a contact element switching mechanism actuated by the rotation of the actuating member, wherein an elastic member whose spring load is smaller than that of the return spring is interposed between the actuation body and the cam follower, wherein the cam follower holds one end of the elastic member and is formed of synthetic resin, and wherein the contact element switching mechanism is actuated when the actuating member rotates to cause a movable contact element to slide on a stationary contact element.

4. A push switch device according to claim 3, wherein both the return spring and the elastic member comprise a coil spring.

5. A push switch device according to claim 3 or 4, wherein at least one of the actuation body and the cam follower is formed of the elastomer.

* * * * *